US005847361A

United States Patent [19]

Yonekawa et al.

[11] Patent Number: 5,847,361

[45] Date of Patent: Dec. 8, 1998

[54] BELT FIXING SYSTEM AND METHOD THEREFOR

[75] Inventors: Noboru Yonekawa, Toyokawa; Satoru Yoneda, Toyohashi; Kazuo Mohri, Toyokawa, all of Japan

[73] Assignee: Minolta Co., Ltd., Osaka, Japan

[21] Appl. No.: 747,510

[22] Filed: Nov. 12, 1996

[30] Foreign Application Priority Data

Nov. 13, 1995 [JP] Japan ..... 7-294556

[51] Int. Cl.[6] ..... G03G 15/20

[52] U.S. Cl. ..... 219/216; 339/69; 339/329

[58] Field of Search ..... 219/216, 469–471; 399/330–333, 69; 432/60; 492/46

[56] References Cited

U.S. PATENT DOCUMENTS

| | | | |
|---|---|---|---|
| 4,582,416 | 4/1986 | Karz et al. | 219/216 |
| 4,931,618 | 6/1990 | Nagata et al. | 219/216 |
| 4,973,824 | 11/1990 | Ohashi et al. | 219/216 |
| 5,250,998 | 10/1993 | Ueda et al. | 219/216 |
| 5,319,429 | 6/1994 | Fukuchi et al. | 219/216 |

FOREIGN PATENT DOCUMENTS

| | | |
|---|---|---|
| 62-10679 | 1/1987 | Japan . |
| 4-147172 | 5/1992 | Japan . |
| 4-352185 | 12/1992 | Japan . |
| 4-365079 | 12/1992 | Japan . |
| 5-313533 | 11/1993 | Japan . |
| 6-318001 | 11/1994 | Japan . |
| 8-69203 | 3/1996 | Japan . |

*Primary Examiner*—Teresa J. Walberg
*Assistant Examiner*—J. Pelham
*Attorney, Agent, or Firm*—Burns, Doane, Swecker & Mathis, LLP

[57] ABSTRACT

A belt fixing system includes a rotatably supported belt, a heating member for heating the belt, a pressure member which contacts with a circumference of the belt to form a nipping region therewith where a toner image supported on a sheet member is fixed onto the sheet member. The system further includes a first detector for detecting a portion of the belt where it has touched with the sheet member at the nipping region, and a controller for controlling the heating member so that an amount of heat supply to the belt is changed in response to an detecting result of the first detector.

16 Claims, 21 Drawing Sheets

BELT FIXING SYSTEM AND METHOD THEREFOR

FIELD OF THE INVENTION

The invention relates to a belt fixing system and a method therefor for use in an electrophotographic image forming apparatus such as copier, printer, and facsimile.

BACKGROUND OF THE INVENTION

Conventionally, as an apparatus for fixing a toner image on a sheet in an electrophotographic image forming machine, there has been well known a fixing roll system. This system typically includes a heat roller having a heat generator therein and a pressure roller forced in circumferencial contact with the heat roller to form a nipping region therewith. With this fixing roll system, a sheet supporting the unfixed toner image is advanced into the nipping region where the toner image is heated and fixed by the heat generator and then fixed onto the sheet by pressure provided by the pressure roller.

With increased requirements of power saving and quick printing, a belt fixing system using a thin walled endless belt is disclosed by JPA 6-318001. According to the system, the thin belt has a lower heat capacity as well as a lower heat radiation so that it can be quickly heated up to a temperature required for fixing the toner image and can reduce a power consumption, which meet the above requirements.

In addition, with an arrangement that a heated belt portion travels near a passage of the sheet to be transported into the nipping region, the sheet can be pre-heated. This allows the toner image to be fully fixed onto the sheet even though a temperature of the belt portion moving past the nipping region is relatively low. This also prevents the toner image and the sheet from being heated too much, which in turn enables the toner to keep its original cohesiveness, i.e., no toner image is fixed excessively. Therefore, only a little amount of releasing material for preventing the toner from being transferred onto the belt is needed, even for a full-color copier or printer. This can minimize and simplify a system for applying the releasing material onto the belt.

As described above, this belt fixing system allows the belt to be heated instantly because of its low heat capacity, however, the trade-off is that the belt loses most of its heat energy by touching the sheet at the nipping region. Therefore, where the sheet to be heated is longer than a circumferencial length of the belt, a portion of the belt cooled down by the contact with the sheet can enter the nipping region without having been heated up to the temperature required for fixing, which causes a poor fixing of the toner image. Also, if the sheet has an elevated heat capacity, the toner images can be transferred onto the belt.

SUMMARY OF THE INVENTION

Accordingly, the object of the invention is to provide an improved belt fixing system and a method for fixing a toner image on a sheet member.

To this end, the fixing system includes a rotatably supported belt, a heating member for heating the belt, a pressure member which contacts with a circumference of the belt to form a nipping region therewith where a toner image supported on a sheet member is fixed onto the sheet member. The system further includes a first detector for detecting a portion of the belt where it has touched with the sheet member at the nipping region, and a controller for controlling the heating member so that an amount of heat supply to the belt is changed in response to an detecting result of the first detector.

Further, a method for compensating a temperature drop of a belt in such belt fixing system includes a first step of detecting a portion of the belt that has contacted with the sheet member at the nipping region, and a second step of changing an amount of heat supply to the belt in response to detecting result in the first step.

With the invention, the belt portion cooled down by the contact with the sheet member can be heated instantly up to a temperature required for fixing toner onto the sheet member, which ensures a positive fixing of the toner image onto the sheet member even though the sheet member is longer than the circumferencial length of the belt.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

PREFERRED EMBODIMENT OF THE INVENTION

Figure 1:
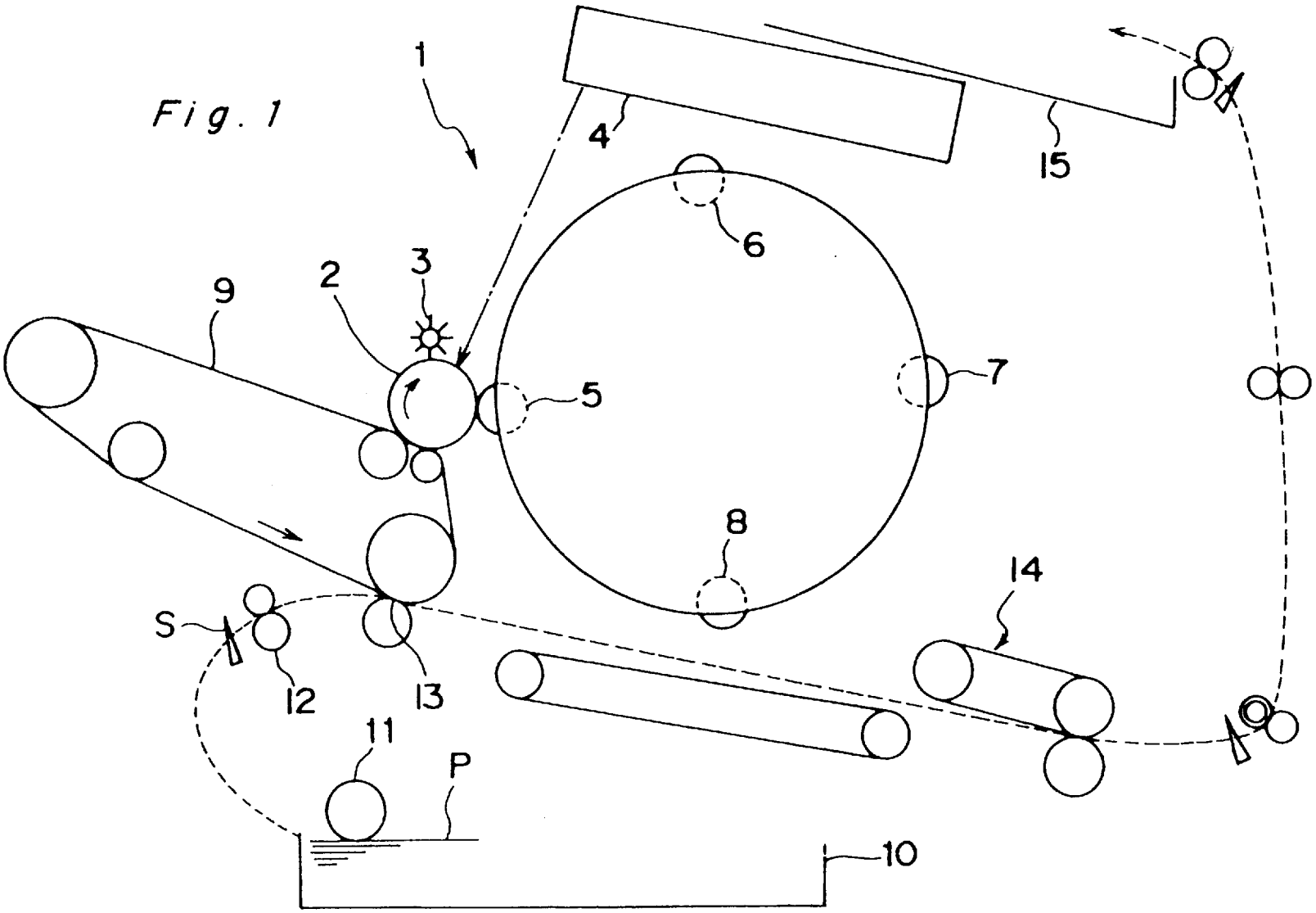
FIG. 1 is a side elevational view of a printer incorporating a fixing system of the invention.

With reference to the drawings, FIG. 1 shows a typical construction of an electrophotographic full-color printer 1 in which a belt fixing system of the invention is incorporated. With this printer 1, a photoconductive member, or photoconductive drum 2, is rotated in a direction indicated by an arrow. During the rotation, incremental portions of the outer periphery of the photoconductive drum 2 are electrically charged by a charger 3. The photoconductive drum 2 thus charged is then exposed by a laser light emitted from an exposure 4 to eventually form an electrostatic latent image therearound.

This electrostatic latent image is visualized into a yellow toner image at a developing station where a first developer 5 confronts the photoconductive drum 1. This image is then transferred onto a transfer belt 9 moving in a direction indicated by an arrow. Likewise, a second and a third electrostatic latent images are formed successively on the photoconductive drum 1 and then are visualized into magenta and cyan toner images by second and third developers 6 and 7, respectively. These toner images are then transferred successively onto the transfer belt 9 in superimposed registration with the first yellow toner image to form a multi-colored image.

A recording member, or sheet P, is fed from a sheet feeder 10 based upon rotations of a feed roller 11. The sheet is then transported into a transfer station 13 in synchronism with the toner images by timing rollers 12, where the full-color toner image is transferred onto the sheet. This sheet is subsequently transported to a fixing system 14 of the invention where the toner images are melted and permanently fixed on the sheet. The resulting sheet having fixed toner images is finally discharged to a catch tray 15.

Note that, if a typical black and white image printing is requested, a developer 8 accommodating a black toner is employed. Further, to detect leading and tailing edges of the sheet P, a sensor S is provided near and on an upstream side of the timing rollers 12 and its output signal is transmitted to a controller where it is used for a temperature control.

Figure 2:
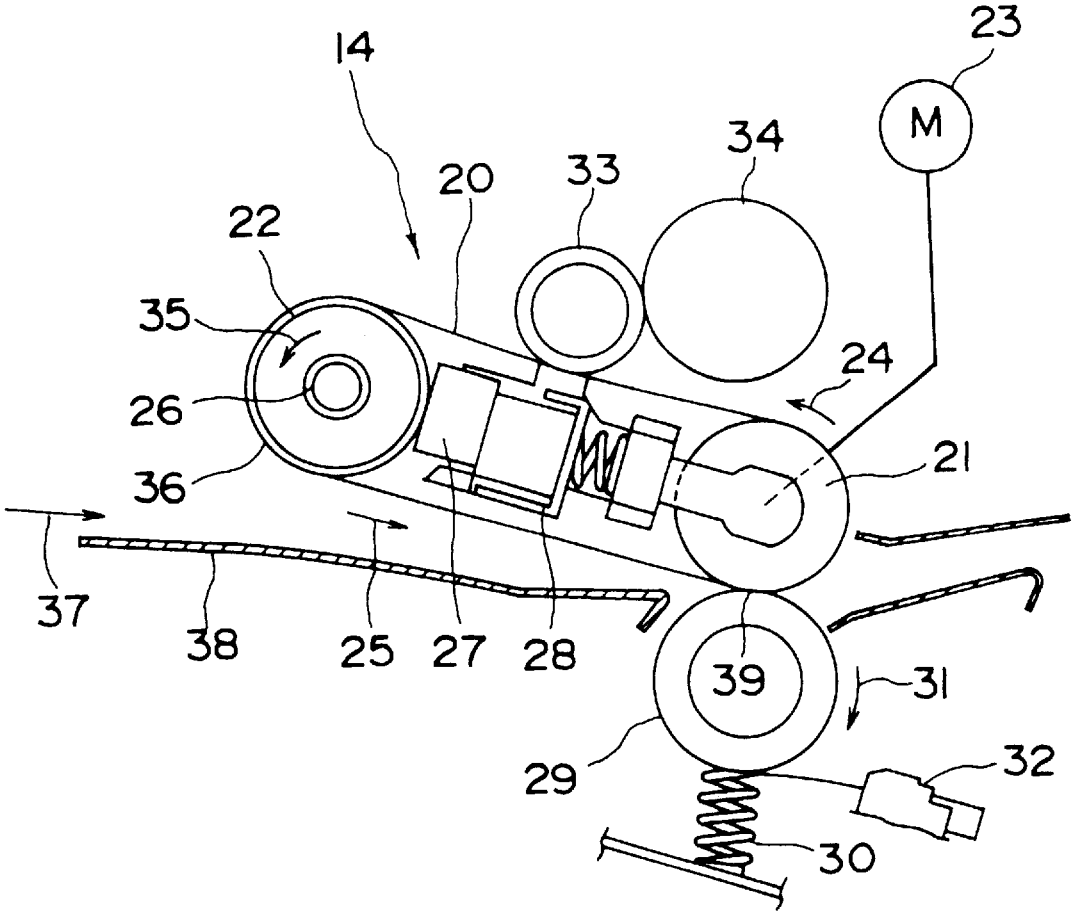
FIG. 2 is a side elevational view of a fixing system.

Referring to FIG. 2, the fixing system 14 includes an endless fixing belt 20. This belt 20, preferably a seamless belt, consists of, for example, a film made of carbon-steel, stainless steel, nickel, or heat resisting resin. Also, the belt 20 preferably has on its outer periphery a heat-resisting offset-preventing layer, made of for example a fluorine resin or a heat resisting rubber such as silicone.

The belt 20 is entrained around a pair of supporting members, or a drive roller 21 and a heat roller 22. The drive roller 21 is connected with a motor 23 so as to rotate in an arrow direction 24. Preferably, the drive roller 21 is covered on its outer periphery by a material having a high friction coefficient, e.g., silicon rubber so as to provide the belt 20 with a positive movement in the direction indicated by an arrow 25 without occurring any slip at contacting surfaces of the roller 21 and the belt 20.

The heat roller 22 on the other hand is preferably made of a material having a higher heat conductivity, e.g., aluminum or copper, so that it can transmit heat to the belt 20. To heat the belt 20, the roller 22 includes in its central portion a halogen lamp 26. Alternatively, this lamp may be replaced by other types of heat generators such as electric resistance material or electromagnetic induction.

It should be noted that, to minimize a heat loss from opposite ends of the roller, using the halogen lamp requires the roller to have a longitudinal length sufficiently longer than a width of the sheet to be possibly used.

Figure 3:
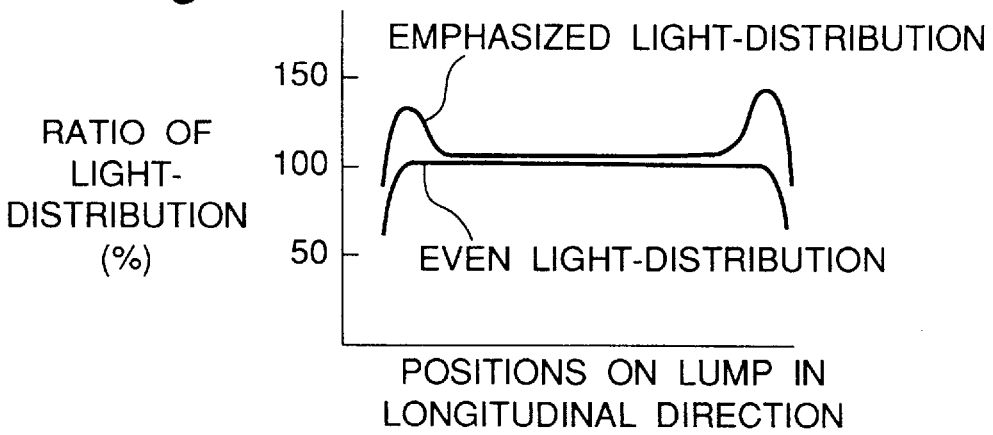
FIG. 3 is a graph which shows a relationship between positions of heat lamp in a longitudinal direction thereof and a ratio of light distribution, the heat lamps having different light distribution characteristics.
Figure 4:
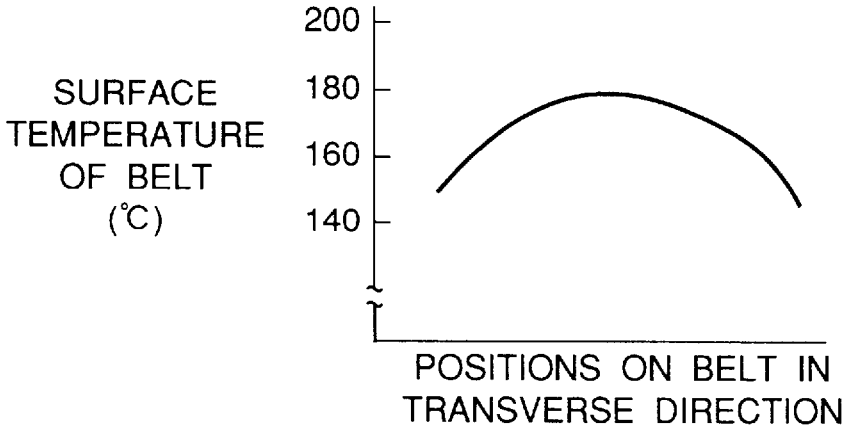
FIG. 4 is a graph which shows a relationship between positions of the belt in a transverse direction thereof and temperatures of the positions.
Figure 5:
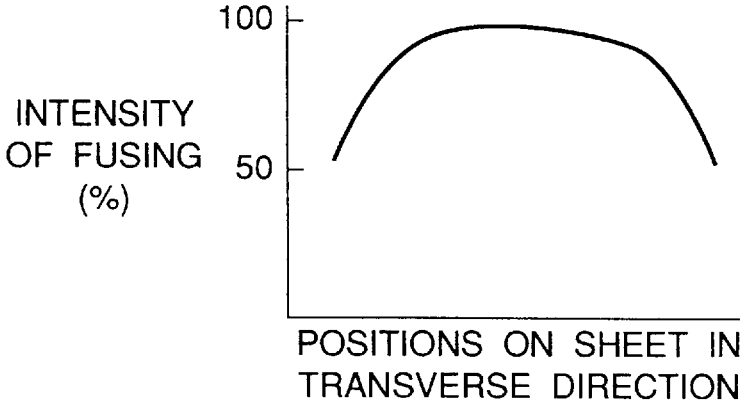
FIG. 5 is a graph which shows a relationship between positions of the sheet in a transverse direction thereof and fixing intensities of the positions.
Figure 6:
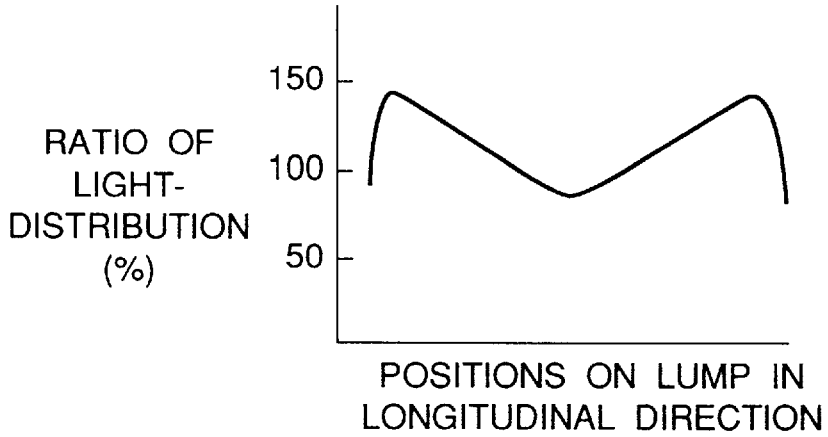
FIG. 6 is a graph which shows a relationship between positions on a heat lamp in a longitudinal direction thereof and the ratio of light distribution by the heat lamp.
Figure 7:
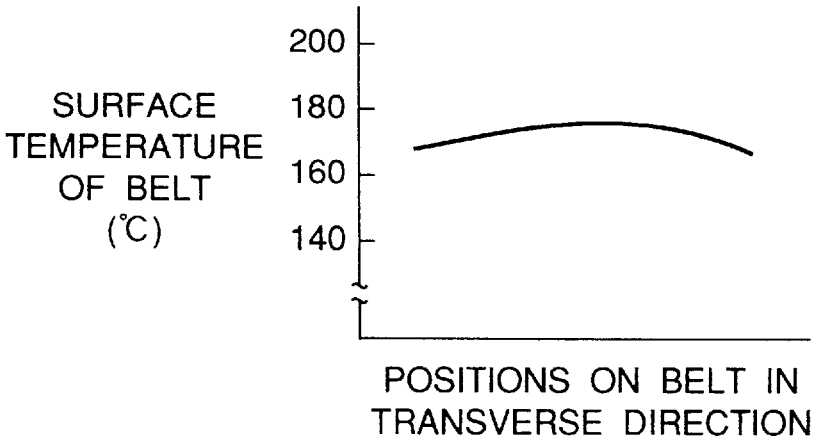
FIG. 7 is a graph which shows a relationship between positions of the belt in a transverse direction thereof and surface temperatures of the positions heated by the heat lamp having the light distribution shown in FIG. 6.
Figure 8:
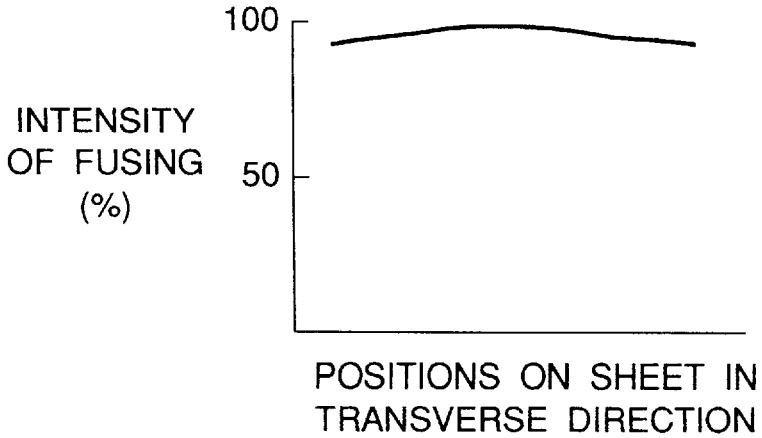
FIG. 8 is a graph which shows a relationship between positions on the sheet on the transverse direction thereof and an intensity of fixing when the sheet is heated by the heat lamp having the light distribution shown in FIG. 6.

Further, to prevent the belt from having large temperature gradients towards opposite circumferencial edges and to eventually provide the belt with an even fixing ability in its transverse direction, a consideration should be made to a distribution of light or heat. Specifically, as shown in FIG. 3, with a conventional heat lamp designed to have an even light-distribution or to have a light distribution in which a light intensity is emphasized at its both ends, a surface temperature of the belt 20 heated by each of them varies in its transverse direction as shown in FIG. 4. As a result, an intensity of fixing of the belt in the same direction distributes as shown in FIG. 5, which causes the toner image to be fixed in different manner depending upon its transverse position. To overcome such fixing gradient, it is preferable to utilize a heat lamp having a light distribution in which the intensity of light increases in directly proportional to the distance from its center as shown in FIG. 6. This ensures the belt to have an even temperature distribution as shown in FIG. 7. and further to have an even fixing-intensity shown in FIG. 8 in its transverse direction.

Referring back to FIG. 2, a thermal sensor 27 is provided inside the belt 20. This sensor 27 is secured on a support member 28 which is positioned by an axis of the heat roller 22, which ensures the sensor 27 to contact with a circumference of the heat roller 22. In this embodiment, the sensor 27 is arranged to be in contact with the heat roller 22, however, this may be arranged outside the belt 20 so as to contact with a portion of an outer surface of the belt 20 that in turn contacts at its opposite inner surface portion with the heat roller 22.

To provide the heat generator 26 with an accurate heat controlling, it is preferable to have the sensor contact with the outer surface of the belt that directly touches both the sheet and the toner image to be heated thereby. This, however, suffers from a local wear in the belt where it touches with the sensor, which possibly results in a noise in a resultant image and decreases a durability of the belt. With this reason, in this embodiment the sensor 27 is so arranged inside the belt 20 as to directly contact with the heat roller 22 and the heat roller 22 is coated at its outer periphery with a material, e.g., fluorine resin, having a low friction coefficient. This arrangement of the sensor 27 results in another advantage that the sensor is not badly influenced by an air stream moving around the belt.

Further, as a safeguard for the heat lamp 26, a thermostat may be provided to disconnect between a power supply and the heat lamp 26 powered thereby for preventing the heat roller 22 from overheating.

A pressure roller 29 is arranged outside the belt 20. The pressure roller 29 is made from a metal tube, a metal rod, or a cylindrical member covered at its outer periphery with a coating layer of silicone rubber or fluoroethylene resin. Also, this roller 29 is forced by a biasing means such as spring 30 against a belt portion supported by the drive roller 21 to form a nipping region 39 therewith. Therefore, upon rotation of the drive roller 21 in the direction of arrow 24, the pressure roller 29 follows the movement of the belt 20 to rotate in the direction of arrow 31 due to friction generated between the roller 29 and belt 20. Further, a thermal sensor 32 is arranged adjacent the pressure roller 29 for detecting a surface temperature of the roller 29.

The pressure roller 29 is preferably coated with a material capable of preventing the toner from adhering thereto. Typically, this material has a lower friction coefficient. As a result, when the sheet is nipped in the nipping region 39, the pressure roller 29 can slip against the belt 20 and the sheet and thereby possibly causes a transport failure of the sheet. To overcome this problem, preferably each of the rollers 21 and 29 and the belt 20 are enlarged in the transverse direction of the belt 29 so as to establish regions at their opposite ends without confronting the sheet to be transported. Further, end portions of the pressure roller 29 in the region are preferably covered by a material that has a higher friction coefficient, which ensures the roller 29 to follow the belt 20.

Further, to extend the nipping region 39 between the pressure roller 29 and the belt 20, the outer surface of the roller 21 is preferably formed with a material having a lower hardness, e.g., sponge rubber.

An oil applying roller 33 is arranged above the belt 20 for applying an offset-preventing oil on the outer surface of the belt 20 so as to provide the belt 20 with a readily separation from the toner. This roller 33 is forced on the outer surface of a belt span travelling from the drive roller 21 towards the heat roller 22 so that the belt 20 is stretched properly. The oil applying roller 33 is in turn contact at its outer surface with a cleaning pad, cleaning roller, or oil supply roller 34. In place of the oil applying roller 31, the oil supply roller 34 may be brought into contact with the belt 20 directly for applying the oil therewith.

Discussions will be made to an operation of the fixing system 14. With this fixing system 14, upon rotation of the motor 23, the drive roller 21 rotates in the direction of arrow 24. This causes the belt 20 to travel in the direction of arrow 25, which in turn rotates the heat roller 22 and pressure roller 29 in the directions of arrows 35 and 31, respectively. Incremental portions of the belt 20 moving past through a region where the belt 20 contacts with the heat roller 22, i.e., heating region 36, receive heat from the heat roller 22 heated by the heat lamp 26. The sheet supporting the unfixed toner image supported thereon but not fixed on the sheet is transported along a guide 38 in a direction of arrow 37 towards the nipping region 39. While being transported on the guide 38, the sheet and the toner image are pre-heated by a belt span running from the heat roller 22 to the drive roller 21. The sheet with the toner image is then advanced into the nipping region 39 where the toner image is fixed by the heat of the belt 20. Also the toner image is permanently fixed on the sheet by the pressure between the rollers 29 and 21. After that, the belt portion contacted with the sheet and thereby deprived of heat is re-heated at the heating region 36. The re-heating operation is carried out according to a temperature control described in detail below.

Next, discussions will be made to considerations in connection with the temperature control. In the conventional well used roller fixing system, the heat roller has a higher heat capacity and thereby the temperature thereof does not decrease too much in spite of heat transmission therefrom to the pressure roller, cleaning member, releasing material applying member, and sheet. Therefore, even in warming, waiting, and printing, the temperature of the heat roller can be kept almost constant according to a well-known hysterisis temperature control. Contrary to this, the fixing system of the invention employs the thin belt having a lower heat capacity than that of the prior art heat roller and thereby the belt is easy to be deprived of its heat. Therefore, temperature of the belt 20 varies a lot depending upon its operational conditions. Also, while waiting still, the belt loses its heat energy except for a specific portion being kept in contact with the heat roller.

In the meantime, in order to provide the belt with an even and elevated fixing ability against the entire surface of the sheet moving fast through the nipping region, each of the incremental portions of the belt advancing into the nipping region should have a constant temperature at least while the sheet is moving past the nipping region. Specifically, the belt should have been heated-up to a certain elevated temperature enough for fixing toner image during from a receiving of an instruction for starting the printing process to the entering of the sheet into the nipping region.

Figure 9:
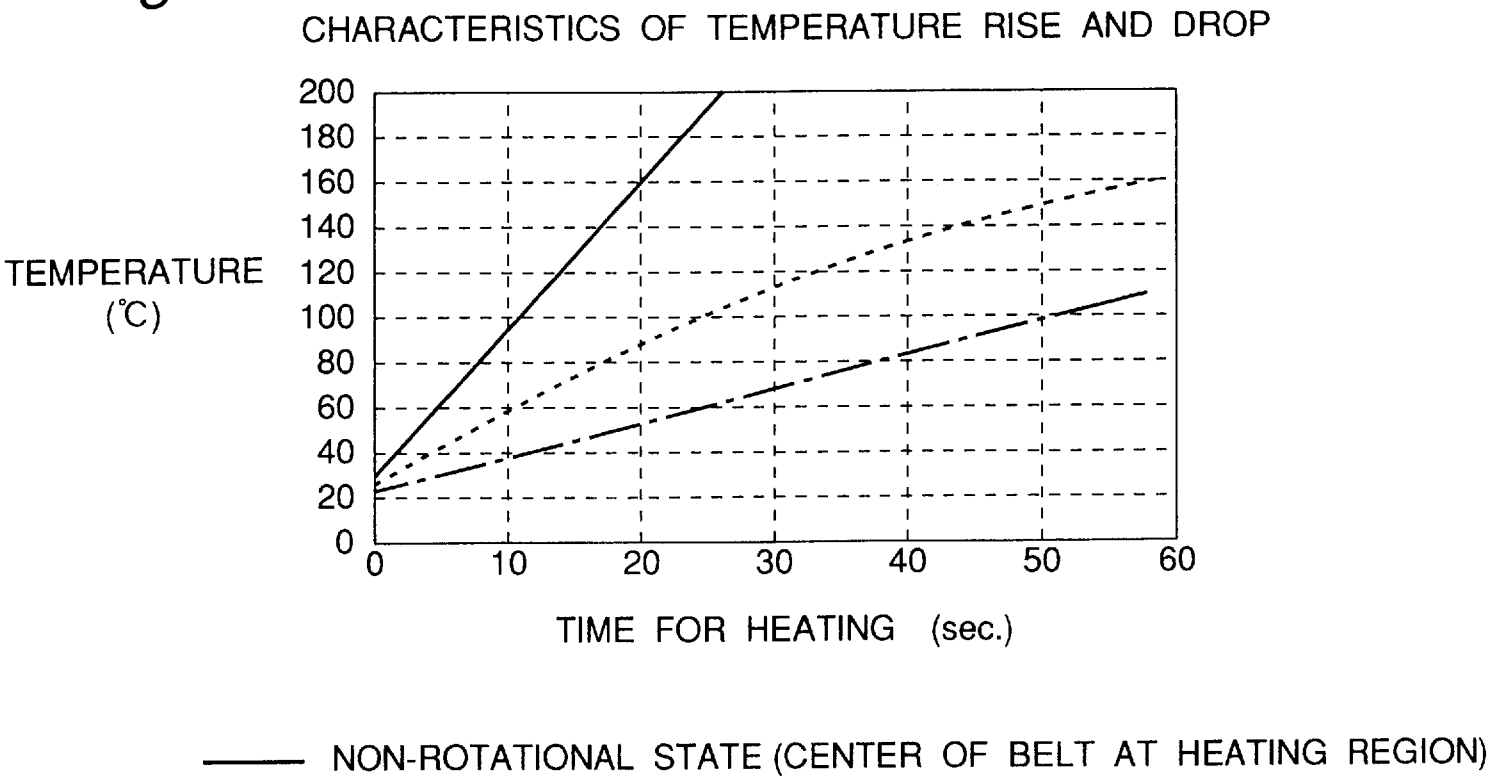
FIG. 9 is a graph which shows characteristics of temperature rises of the belt and the pressure roller.
Figure 10:
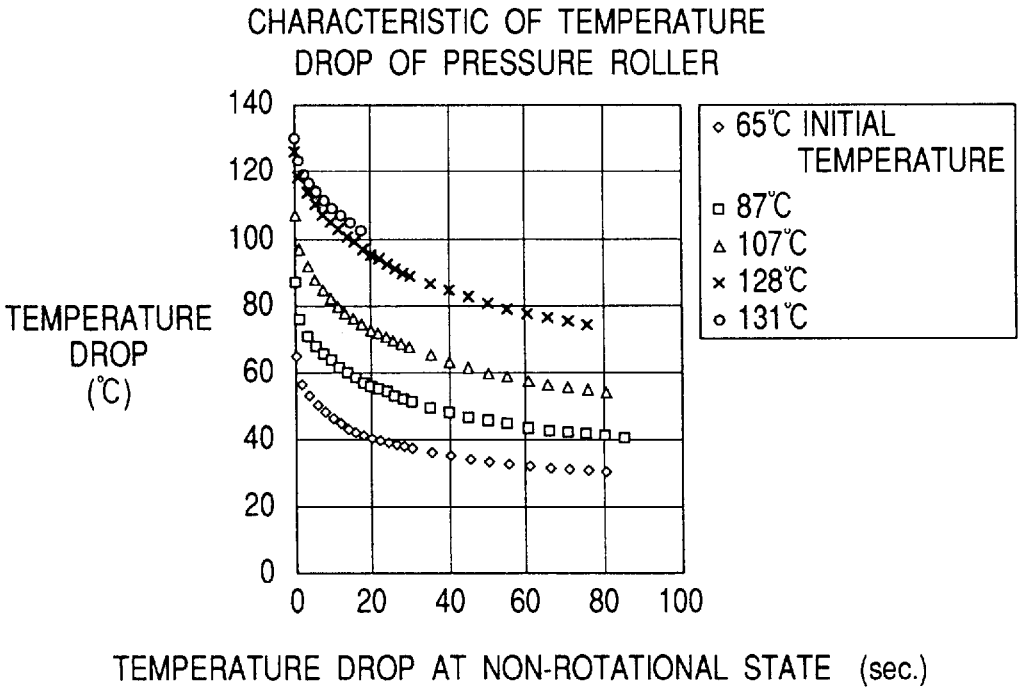
FIG. 10 is a graph which shows a characteristic of temperature drop of the pressure roller.
Figure 11:
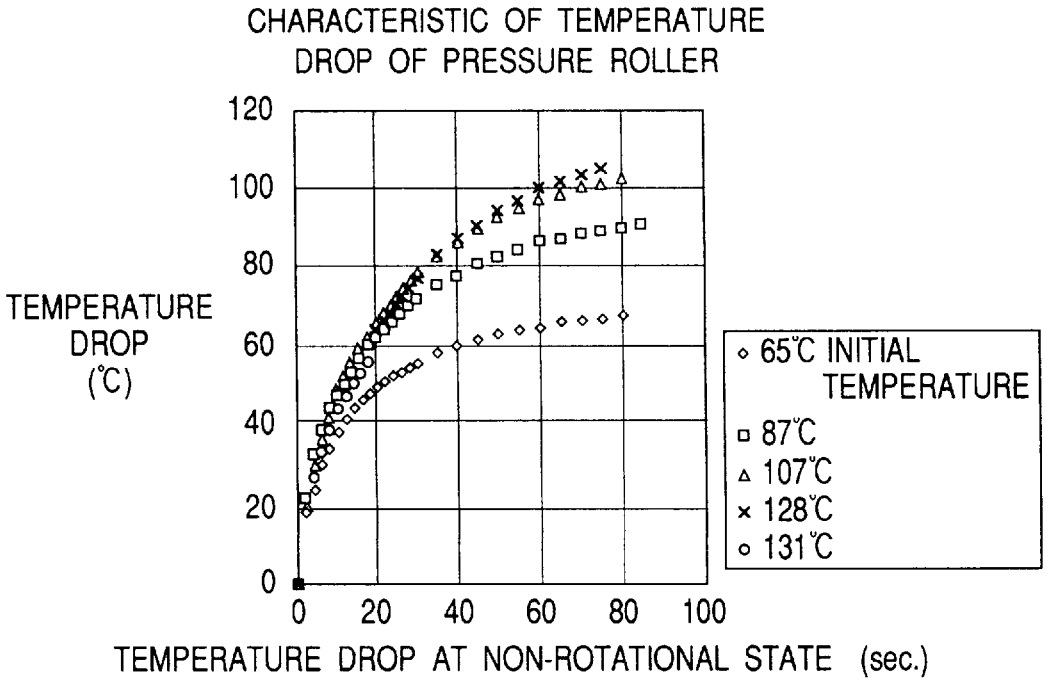
FIG. 11 is a graph which also shows a characteristic of temperature drop of the pressure roller.

With reference to FIGS. 9 to 14, features of the members utilized in the fixing system of the invention will be described in detail. Assuming that the temperature needed for fixing the toner is about 160° C. In this situation, as shown in FIG. 9 a warming-up of approximately 60 seconds is needed for heating the central portion of the belt up to the same temperature, i.e., 160° C. The graph also shows that, when the belt is heated without being rotated, the specific portion kept in contact with the heat roller can be heated up to the same temperature within about 20 seconds. Also, if no printing is carried out for a while after the warming-up, the temperature of the heated portions of the belt 20 will decrease according to characteristics of temperature drop shown in FIGS. 10 and 11. Therefore, the cooled portions should be re-heated up to the temperature required for fixing before entering into the nipping region.

Figure 12:
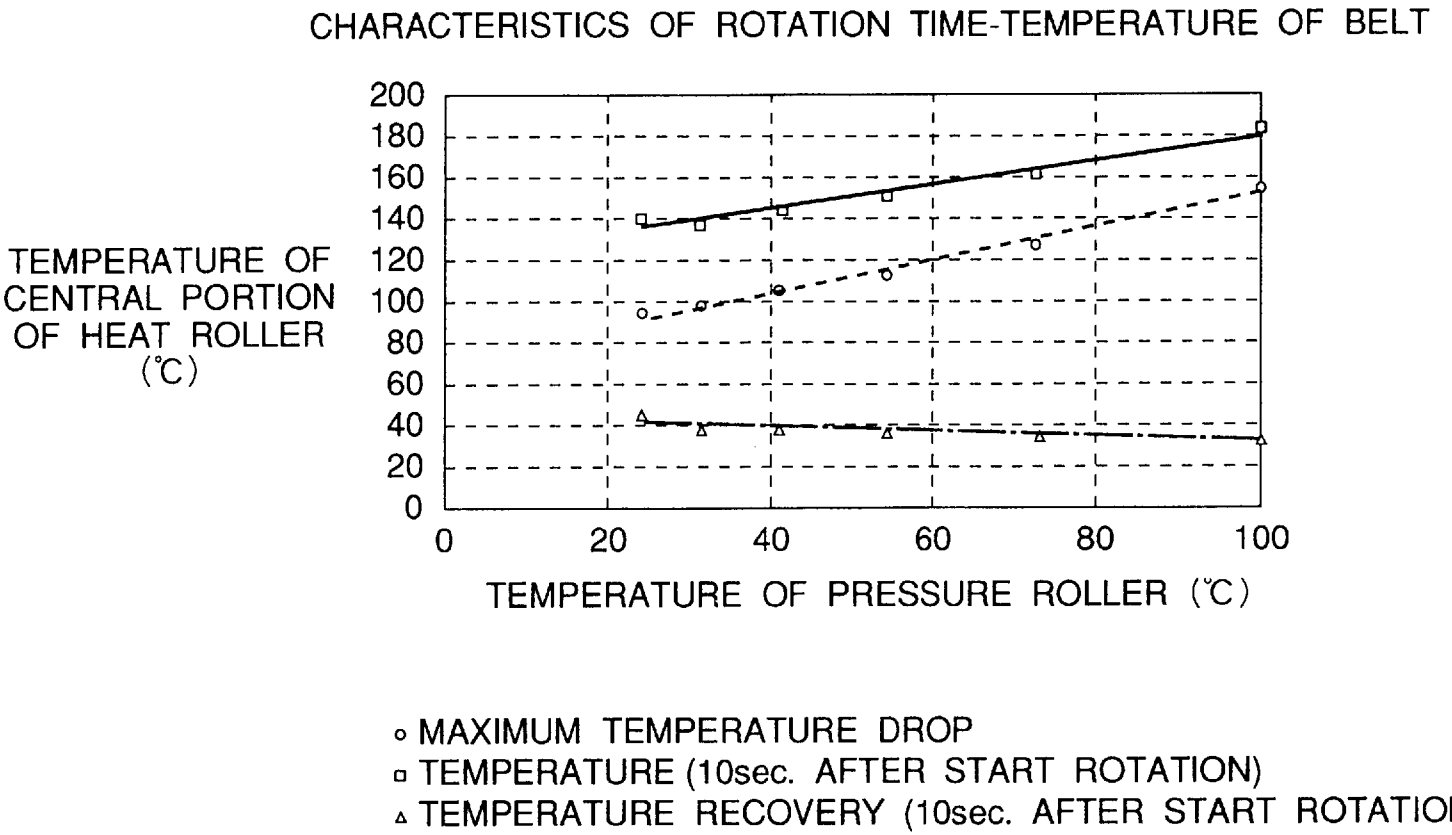
FIG. 12 is a graph which shows a characteristic of temperature of the heat roller.
Figure 13:
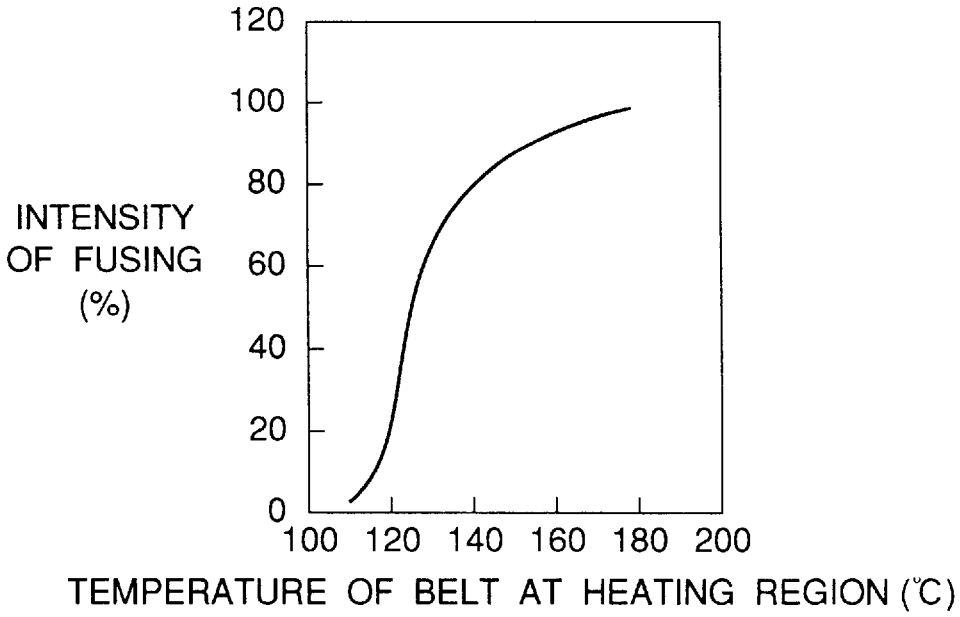
FIG. 13 is a graph which shows a relationship between a temperature of the belt and a fixing intensity.
Figure 14:
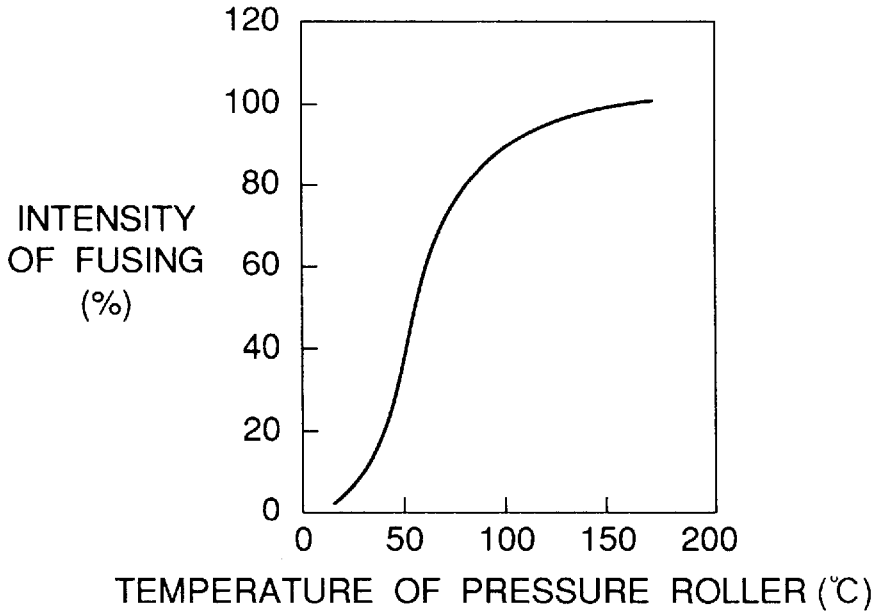
FIG. 14 is a graph which shows a relationship between a temperature of the pressure roller and a fixing intensity.

Next, assuming that the printer requires about 10 seconds from the instruction of the print starting to the entering of the sheet into the nipping region. In this case, to heat the outer surface of the heat roller up to 150° C. within the 10 seconds, a surface temperature of the pressure roller 29 should be kept at 70° C. or more even in waiting, as shown in FIG. 12. A typical approach to keep the surface temperature above 70° C. is to reheat it when the temperature drops below the same and to prohibit the printer from starting the printing operation during the reheating. However, this approach results in a significant power consumption because the heater is automatically powered even in waiting of the printer.

When the printer has a automatic power-off mode by which the printer is automatically powered off unless any printing is instructed for a predetermined period of time, it is important to prevent the surface temperature from droping down below 70° C. before starting the automatic power-off mode. To this end, it is suitable to warm-up the pressure roller 29 up to a certain temperature condition that can keep its surface temperature from dropping down below 70° C. in the warming-up operation. Further, to set the fixing system into a state capable of fixing the entire toner image onto the sheet firstly fed after the start of printing without carrying out any warm-up operation, it is preferable to detect the temperature of the heat roller right before or after printing and then to delay the start of printing until the fixing system will be ready for fixing. A period of time for delaying the first printing can be determined according to the temperature of the pressure roller detected immediately before the print starting or a temperature drop of the heat roller at the time of print starting, or can be a time required for heating the pressure roller to an aimed temperature.

Figure 15:
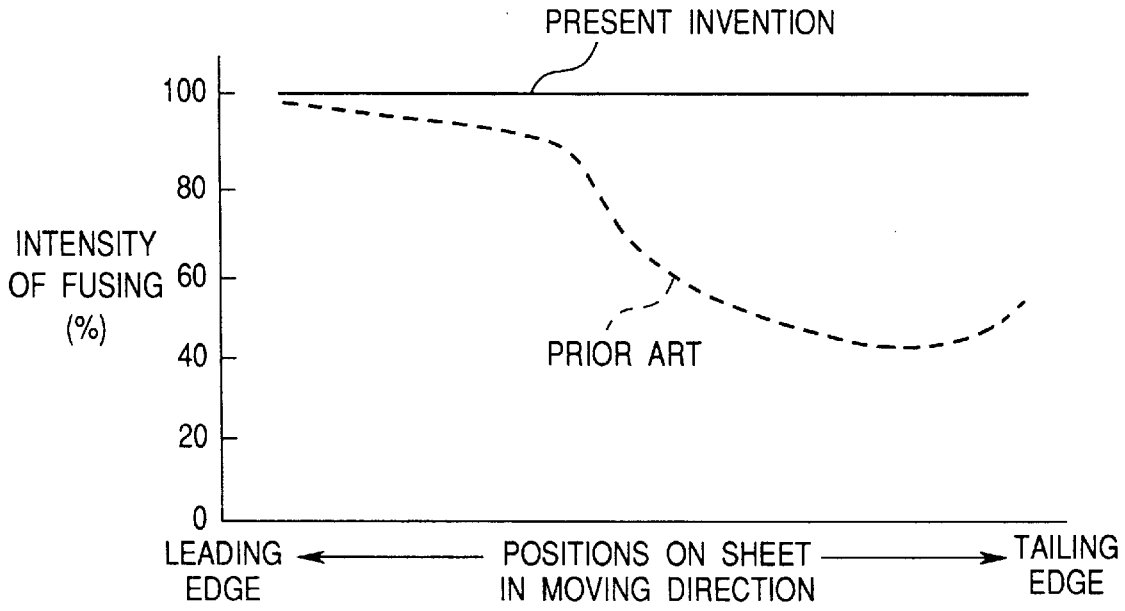
FIG. 15 is a graph which shows positions on the sheet in its moving direction and a fixing intensity.

As described before, since the belt has a low heat capacity, the surface temperature thereof drops significantly when it brings into contact with the sheet at the nipping region. Particularly, if the sheet has a length in the moving direction longer than the circumferential length of the belt, the belt portion which has been in contact with the leading portion of the sheet at the nipping region and has cooled down can re-enter the nipping region without having been heated to a necessary temperature and bring into contact with the tailing portion of the same sheet, which results in a fixing failure and, if the sheet has an elevated heat capacity, the toner offsetting. A variation of the fixing intensity in the moving direction of the sheet is illustrated in FIG. 15 by a dotted line.

Based upon the above consideration, in the fixing system of the invention the temperature of the belt portion that has passed through the nipping region is estimated and then the temperature drop portion in the belt is heated to the temperature required for fixing. Also, since an optimum thermal calory to be supplied to the sheet in order to perform a suitable fixing depends upon characteristics of the sheet, for instance, its weight. Therefore, if a plurality of sheet are transported into the fixing system successively, for the second and the subsequent sheets, the heat calory to be supplied to the sheet is controlled depending upon a temperature of the pressure roller. This heat control is preferably carried out by changing a duty ratio of a voltage applied to the heat lamp. With these controls, the sheet and the toner image supported thereon can be heated in a same manner in the nipping region (see FIG. 15).

Figure 16:
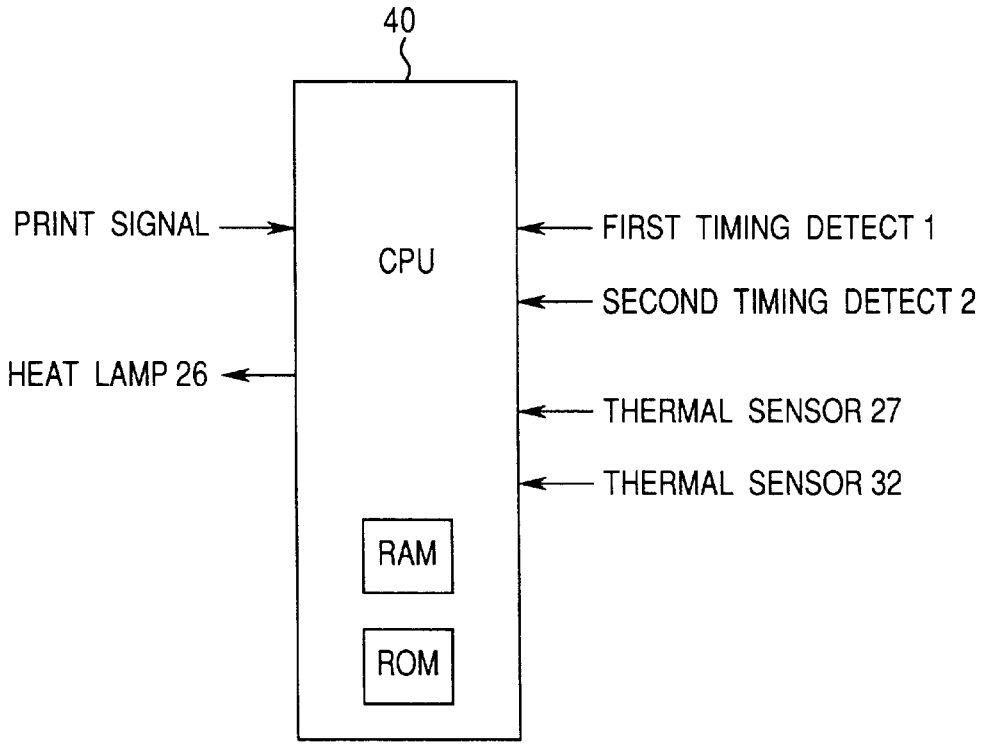
FIG. 16 is a circuit diagram which shows a controller and signals output therefrom and input thereinto.
Figure 17:
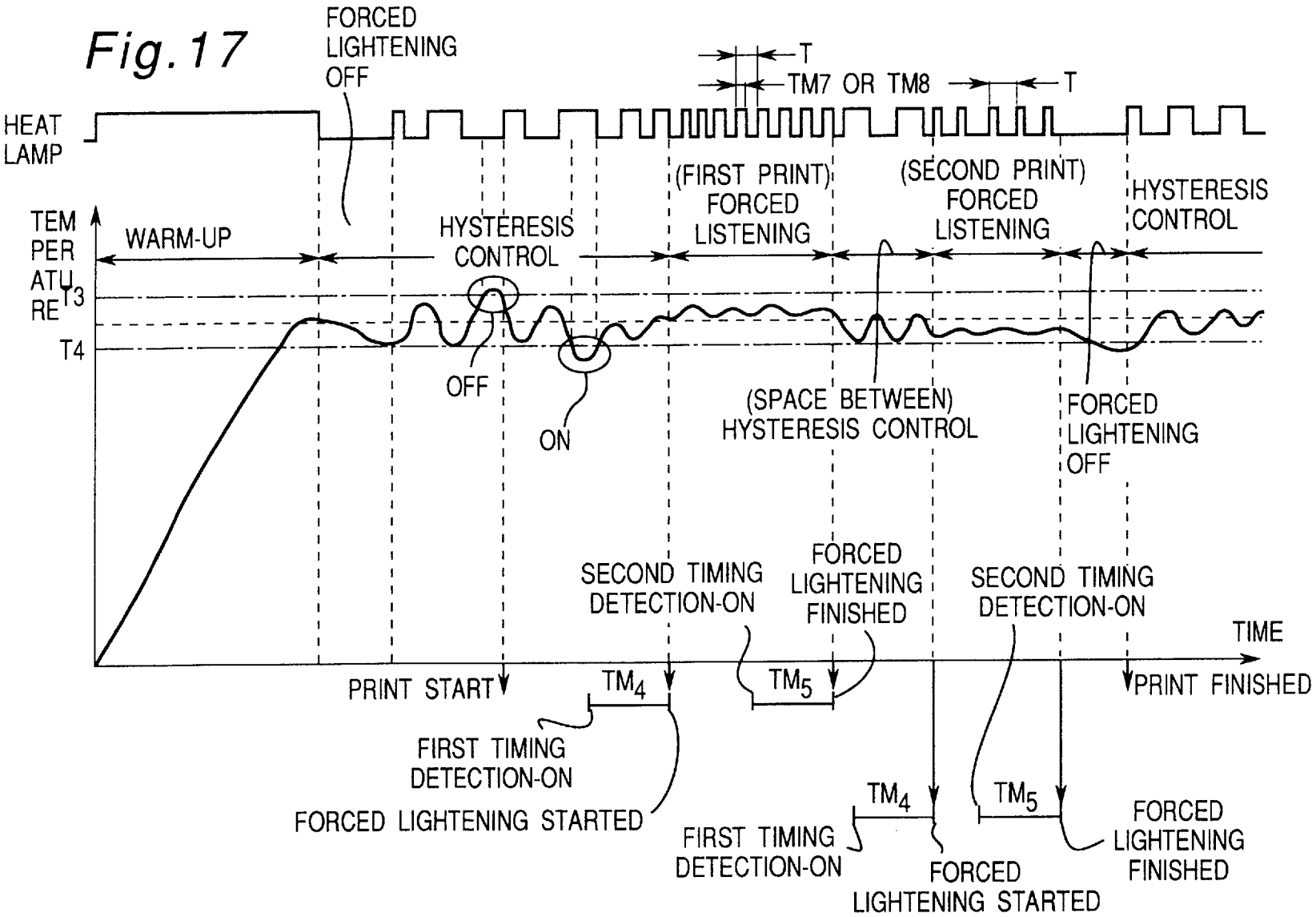
FIG. 17 is a graph which shows a temperature variation in the belt.

With taking the above description into account, as shown in FIG. 16, the printer 1 includes a central processing unit (CPU) 40 which carries out a thermal control according to a program shown in FIG. 17. Details of the program is illustrated in FIGS. 18 to 28, which will be described below.

Figure 18:
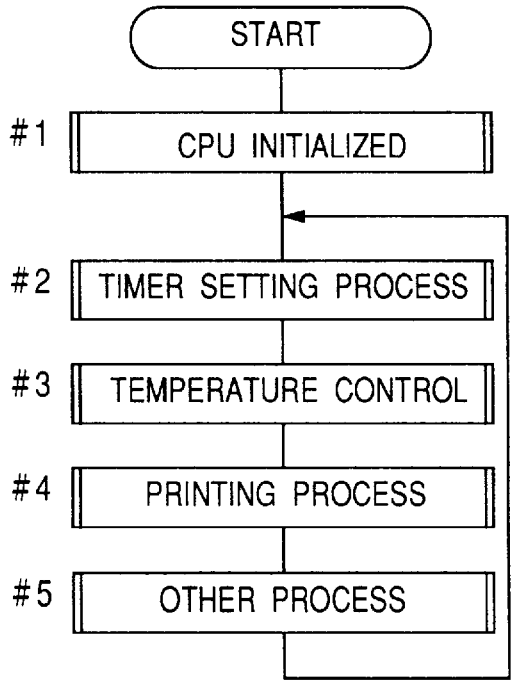
FIG. 18 is a main flowchart of a program carried out in the controller.

(1) Main Routine (see FIG. 18)

Figure 19:
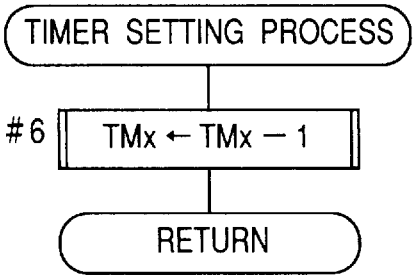
FIG. 19 is a flowchart of a timer process in the program.

In a main routine of the program shown in FIG. 18, the central processing unit (CPU) is initialized at step #1. Subsequently, a timer setting process, a temperature control, a printing process, and other process are performed successively at respective steps #2 to #5. In the timer setting process at step #2, as shown in FIG. 19, an internal timer TMx is decremented by "1". The series of processes from the timer setting process to other process are carried out at every time when the internal timer TMx has finished.

Figure 20:
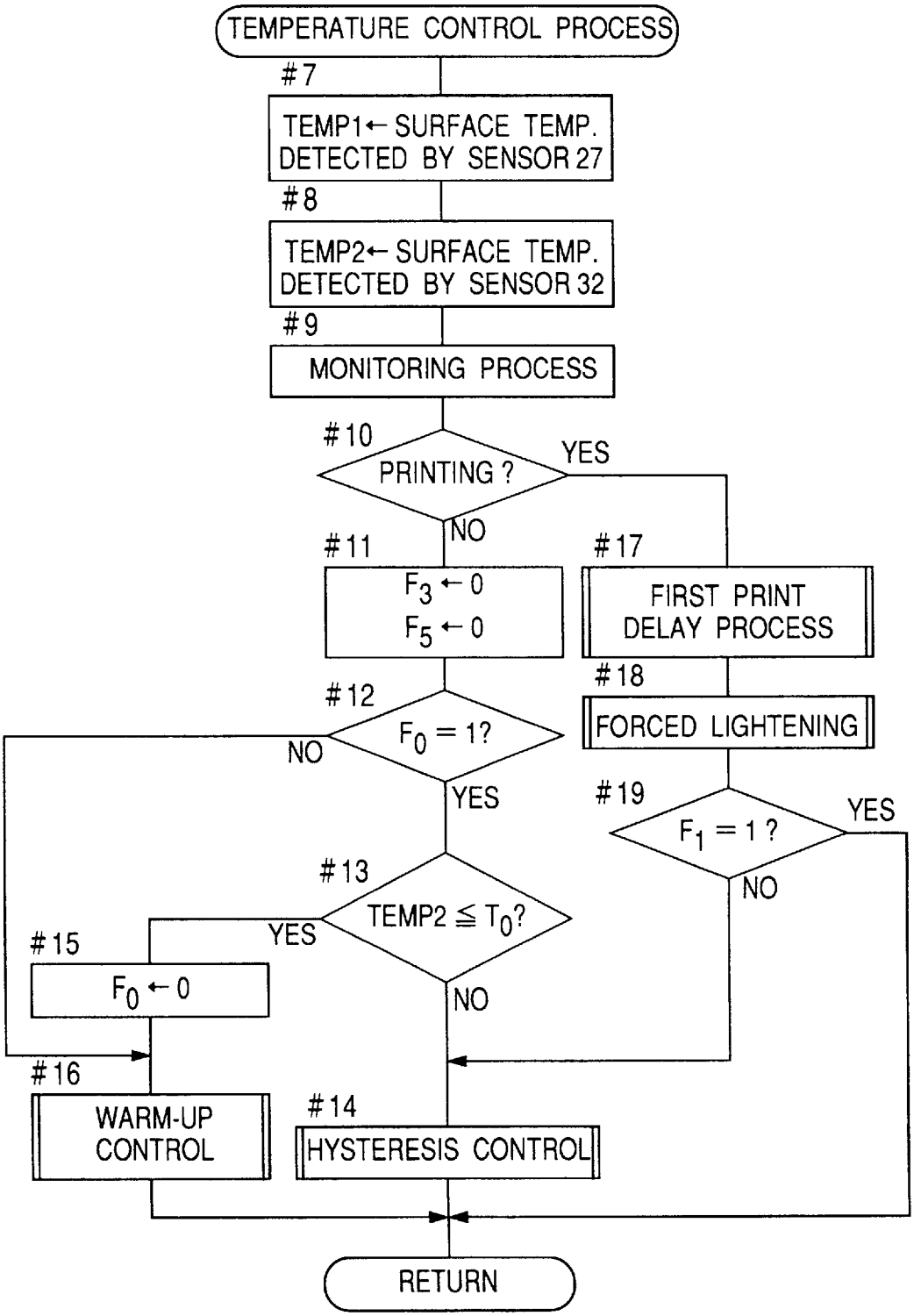
FIG. 20 is a flowchart of a temperature control process in the program.

(2) Temperature Control Process (see FIG. 20)

In the temperature control process at step #3, as shown in FIG. 20, a temperature TEMP1 is determined at step #7 from an output of the thermal sensor 27 which detects the surface temperature of the heat roller 22. Also, a temperature TEMP2 is determined at step #8 from an output of the thermal sensor 32 which detects the surface temperature of the pressure roller 29. Further, based upon the temperature TEMP1, it is determined at step #9 whether the temperature of the heat roller 22 is increasing or decreasing at a monitoring process. Then, it is determined at step #10 whether the printing operation is carried out at present.

If it is determined that the printing operation is not performing at step #10, a flag F3 used for judging whether a first print delay-process has been completed and a flag F5 used for judging whether a forced lightening process has completed are set to "0" at step #11. Then, a determination is made at step #12 whether a flag F0 used for judging whether a warm-up control has completed is "1". When the flag F0 is "1", i.e., the warm-up control has already finished, it is determined at step #13 whether the temperature TEMP2 of the pressure roller 29 which is in the waiting state is equal to or less than T0, i.e., 70° C. If the TEMP2 is greater than 70° C., a hysterisis temperature control described below is carried out at step #14. However, if the TEMP2 is equal to or less than 70° C., after setting the warm-up control flag F0 to "0" at step #15, the warm-up control is carried out at step #16. When at step #12 it is determined that the warm-up control flag F0 is "0", i.e., the warm-up control is now being performed, the program continues the warm-up control at step #16.

If it is determined at step #10 that the printer is carrying out the printing operation, the first print delay process for delaying the first print in a continuous printing and then a forced lightening process are carried out at steps #17 and #18, respectively. Then, it is determined at step #19 whether the forced lightening flag F1 is "1", i.e., the heat lamp 26 is switched on by force at present. When the heat lamp 26 is forcibly switched on, the present condition is kept, but, if not, a hysterisis temperature control is started instead at step #14.

Figure 21:
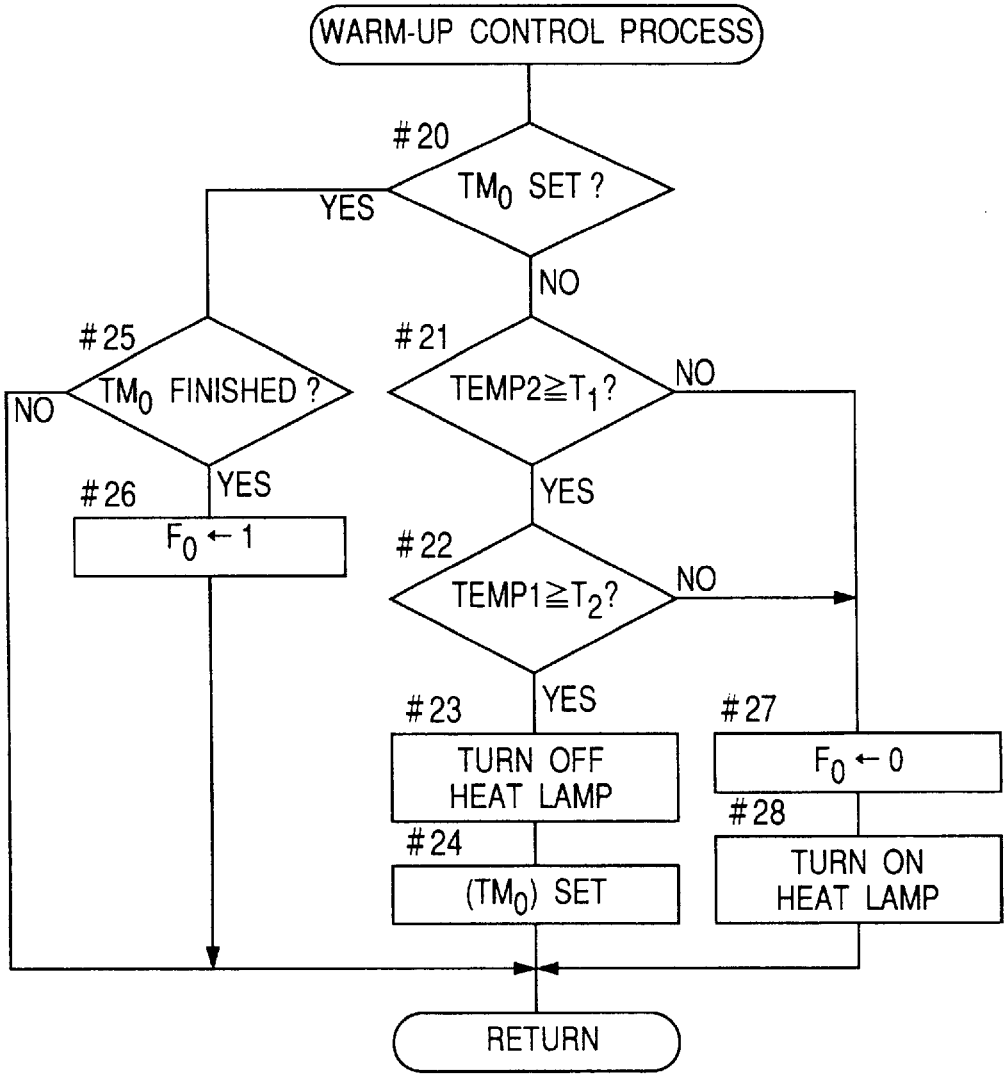
FIG. 21 is a flowchart of a warm-up control process in the program.

(3) Warm-up control (see FIG. 21)

In the warm-up control at step #16, it is determined at step #20 whether a timer TM0 for preventing an over-shooting has been set. If not, a determination is made at step #21 whether the TEMP2 of the pressure roller 29 is equal to or more than a predetermined temperature T1, or 60° C., which is used for judging the completion the warm-up operation of the pressure roller 29 and then another determination is made at step #22 whether the TEMP1 of the heat roller 22 is equal to or more than a predetermined temperature T2, or 145° C., to be used for judging the completion of the arm-up operation of the heat roller 22. If the TEMP2 is lower than T1 and/or TEMP1 is lower than T2, the warm-up control flag F0 is set to "0" at step #27 and then heat lamp 26 is switched on to start the warm-up operation at step #28. Contrary, if the TEMP 2 is equal to or greater than T1 and the TEMP 1 is also equal to or greater than T2, the heat lamp 26 is switched on at step #23 and then the timer TM0 is started at step #24.

If it is determined at step #20 that the timer TM0 has been started, a determination is made at step #25 whether the timer TM0 has finished. Once the timer TM0 has finished, the warm-up control flag F0 is reset to "1" at step #26. However, if the timer TM0 has not finished yet, the present operational state is kept. According to this warm-up control, because the warm-up control is carried out based upon respective temperatures of the heat roller 22 and the pressure roller 29, an accurate temperature control can be accomplished.

Figure 22:
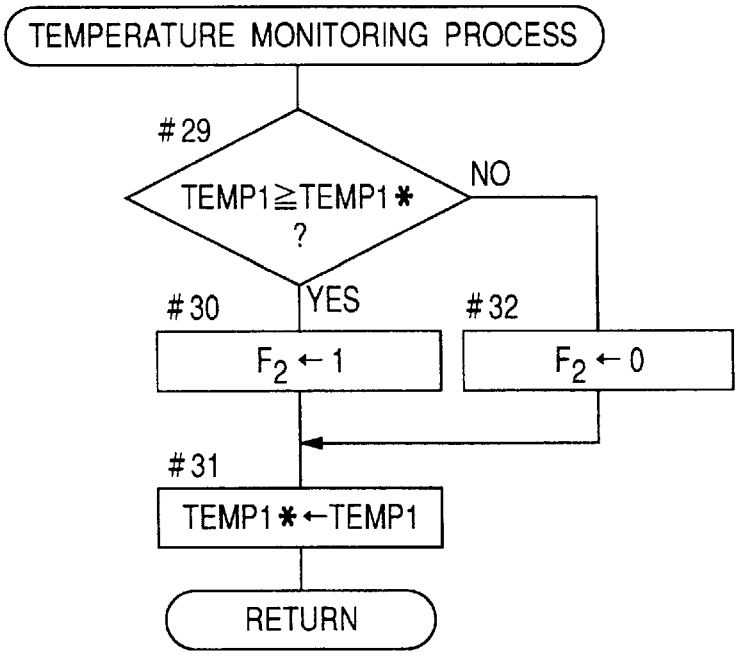
FIG. 22 is a flowchart of a temperature monitoring process in the program.

(4) Temperature Monitoring (see FIG. 22)

In the temperature monitoring (#9), at step #29 the temperature TEMP1 of the heat roller 22 is compared with a temperature TEMP1* that has been detected during the previously set internal timer. If the present TEMP1 is equal to or greater than the old TEMP1*, which means that the temperature of the heat roller 22 is increasing, the temperature monitoring flag F2 is set to "1" at step #30 and the TEMP1* is updated to the TEMP1 at step #31. If otherwise, the temperature monitoring flag F2 is set to "0" at step #32 and the TEMP1* is updated to the TEMP1 at step #31.

Figure 23:
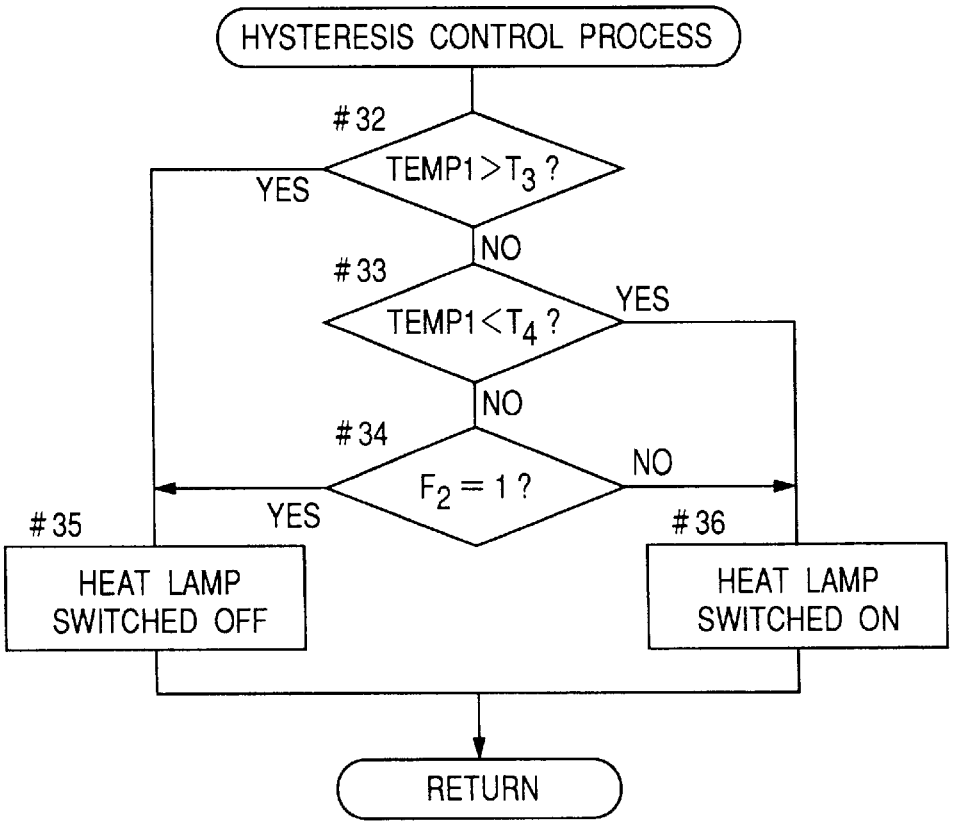
FIG. 23 is a flowchart of a hysterisis control process in the program.

(5) Hysterisis Control (see FIG. 23)

In the hysterisis control at step #14, a determination is made at step #32 whether the temperature TEMP1 of the heat roller 22 is higher than an upper limit T3 at step #32 and then another determination is made at step #33 whether the temperature TEMP1 is lower than the lower limit T4. When the TEMP1 is higher than the upper limit T3, the heat lamp 26 is switched off at step #35. Contrary to this, when the TEMP1 is lower than the lower limit T4, the heat lamp 26 is switched on. If, however, the TEMP1 is equal to or lower than the upper limit T3 but equal to or higher than the lower limit T4, it is determined at step #34 whether the temperature monitoring flag F2 is "1", i.e., the temperature of the heat roller 22 is increasing. If the temperature of the heat roller 22 is increasing, the heat lamp is switched off at step #35. Contrary to this, if the temperature of the heat roller 22 is decreasing, the heat lamp is switched on at step #36.

Figure 24:
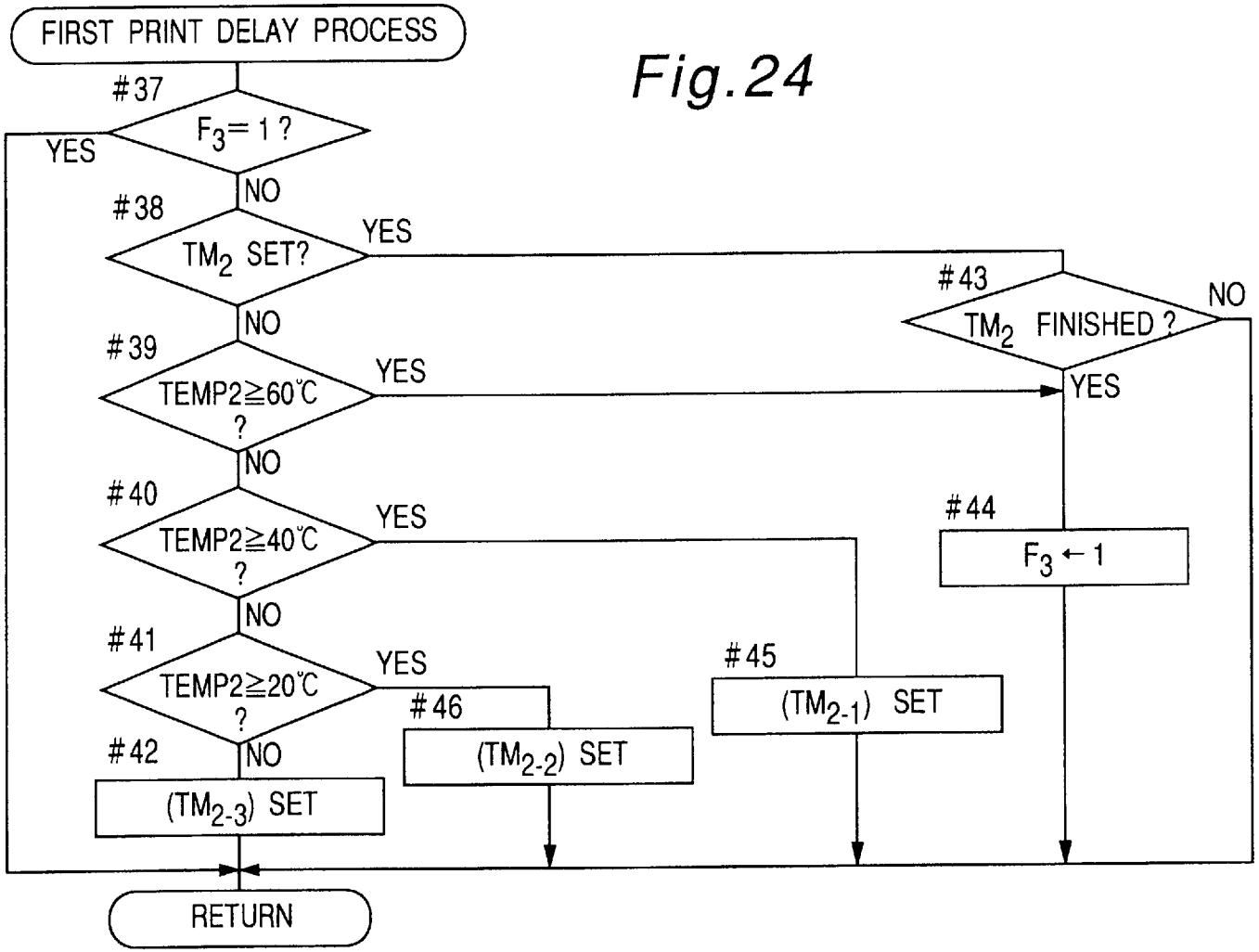
FIG. 24 is a flowchart of a first print delay process in the program.

(6) First Print Delay Control (see FIG. 24)

In the first print delay control at step #17, a determination is made at step #37 whether the first-print delay control completion judge flag F3 is set to "1", i.e., whether the program is carrying out the first print delay control (F3=0) or the program has already finished the first print delay control and is performing the printing operation (F3=1). When the program is performing the first print delay control at present, it is determined at step #38 whether a first print delay timer TM2 (Timer TM2-1, TM2-2, or TM2-3) has been started. If one of the timers TM2 has not started yet, determinations are made whether the temperature TEMP2 of the pressure roller 29 is equal to or greater than 60° C., 40° C., and 20° C. at respective steps #39, #40, and #41. As a result, when the TEMP2 of the heat roller 22 is lower than 20° C., the program set the timer TM2-3 at step #42 so as to delay the start of first printing for a time period T2-3 defined by this timer TM2-3. When the TEMP2 is equal to or greater than 20° C. but less than 40° C., the program set the timer TM2-2 at step #46 so as to delay the start of first printing for a time period T2-2 defined by this timer TM2-2. When the TEMP2 is equal to or greater than 40° C. but less than 60° C., the program set the timer TM2-1 at step #45 so as to delay the start of first printing for a time period T2-1 defined by this timer TM2-1. When the TEMP 2 is 60° C. or more, the program sets the first print delay control completion judge flag F3 to "1" and then finishes the delay control at step #44.

The lengths of time periods T2-1, T2-2, and T2-3 have a following relationship:

$$T2\text{-}1 < T2\text{-}2 < T2\text{-}3$$

Although these time periods depend upon calorific power emitted from the heat lamp 26 and a material and length of the belt 20, specific time periods from 10 to 40 seconds are assigned to each time periods T2-1, T2-2, and T2-3 so as to meet the above relationship.

Meanwhile, if it is determined at step #38 that one of these timers TM2-1, TM2-2, or TM2-3 has been set, another determination is made at step #43 whether the timer set has finished. Once the timer has finished, the program set the first print delay control completion judge flag F3 to "1" and then finishes the delay control at step #44. If, however, the timer has not finished yet, the program keeps waiting.

As described above, in this first print delay process, firstly the program detects the temperature of the heat roller 22 and then sets the first print delay timer depending upon the detected temperature. Also, while the timer set is counting, the program increases the respective temperatures of the heat roller, belt, and pressure roller up to those suitable for fixing. Further, as the starting of the first print is controlled by the timer TM2 selected depending upon the detected temperature of the pressure roller 29, no thermal sensor is needed for detecting the temperature of the heat roller 22. Furthermore, since the pressure roller 29 is directly in contact with the outer surface of the belt 20, a variation of the temperature on the surface of the belt 20 can be detected accurately by detecting the temperature of the pressure roller 29, which ensures a precise controlling of the temperature in the fixing system.

Figure 25:
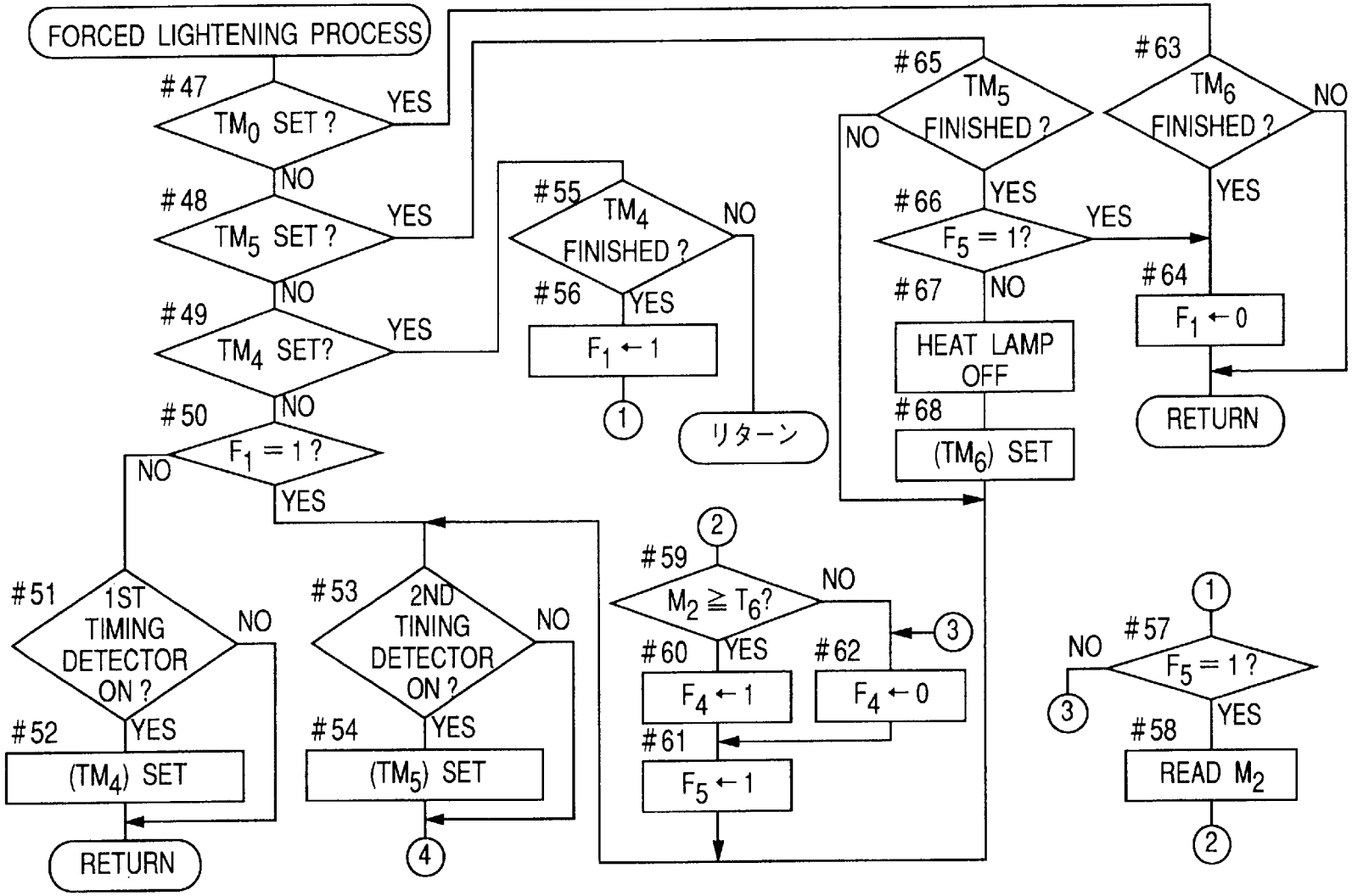
FIG. 25 is a flowchart of a forced lightening process in the program.
Figure 26:
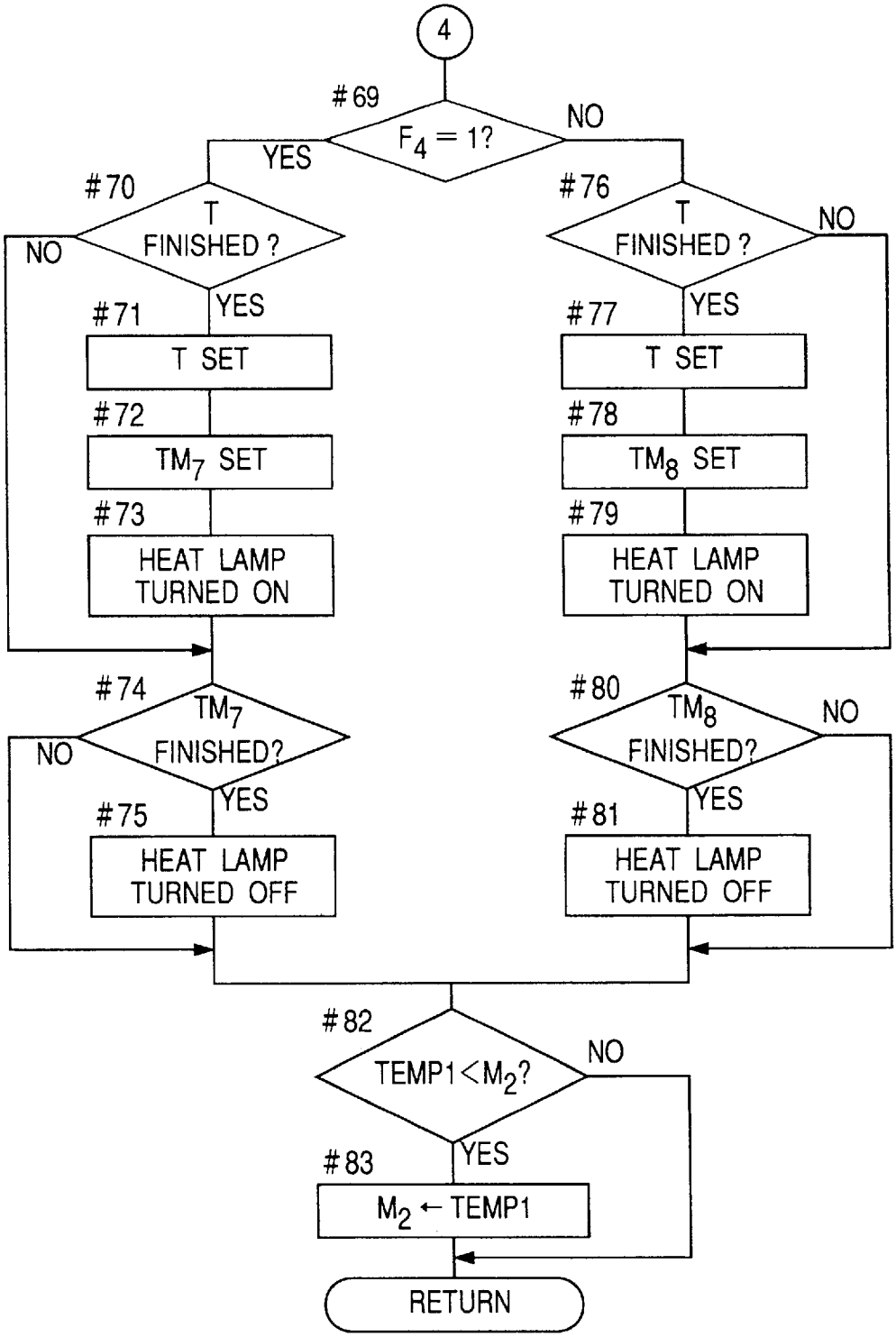
FIG. 26 is also a flowchart of the forced lightening process subsequent to FIG. 25.

(7) Forced Lightening (see FIGS. 25 and 26)

In forced lightening, i.e., at step #18, determinations are made at respective steps #47, #48, #49 whether one of an overshooting preventing timer TM0, a forced light-off timer TM5, or a forced light-on timer TM4 has been set. The timer TM4 is defined that it is slightly shorter than a time period from when a first timing detector is turned on to when a leading edge of the cooled portion in the belt that has been in contact with the sheet enters the heating region 36. The timer TM5 is defined by a time period from when a second timing detector is turned on to when a tailing edge of the cooled portion in the belt enters the heating region 36. The first timing detector is turned on by detecting an on-edge, i.e., change of signal from off-state to on-state, of the sensor S adjacent the timing rollers 12 while the second timing detector is turned off by detecting an off-edge, i.e., change of signal from on-state to off-state, of the sensor S.

When none of these timers TM0, TM4, or TM5 has been set, a determination is made at step #50 whether the forced lightening flag F1 is "1". If the forced lightening flag F1 is "1", another determination is made at step #53 whether the second timing detector has been turned on. Also, if the second timing detector has been turned on, the timer TM5 is started at step #54. Contrary to this, if the forced lightening flag F1 is "0", a determination is made at step #51 whether the first timing detector is turned on. If the first timing detector is turned on, the timer TM4 is started at step #52.

When neither the overshoot preventing timer TM0 nor the timer TM5 is started but the timer TM4 has already been started, the program waits at step #55 until the timer TM4 will finish. Once the timer TM4 has finished, the forced lightening flag F1 is set to "1" at step #56. Then, a determination is made at step #57 whether the forced lightening flag F5 is "1", i.e., the forced lightening is performing at present. With this forced lightening, the temperature of the belt portion cooled down by the contact with the sheet is heated up to the specific temperature required for fixing. If the forced lightening is now performing, the program reads out a temperature M2 stored in a random access memory RAM at step #58. Then a determination is made at step #59 whether the temperature M2 is equal to or higher than a temperature T6, e.g., 155° C. This temperature T6 is used as a threshold for changing an on-off duty ratio of a voltage to be applied to the heat lamp 26. Also, the temperature M2 is the lowest temperature of heat roller detected during the forced lightening control as described below and this temperature M2 can be utilized for determining the decrease in temperature of the belt portion that has contacted with the sheet in the nipping region. The reason is that the temperature M2 of the heat roller decreases in proportion to the decrease in temperature of the belt because the belt portion cooled by the contact with the sheet deprives greater amount of heat from the heat roller.

If the temperature M2 is greater than the threshold T6, a lowest temperature judging flag F4 is set to "1" at step #60 and then the forced lightening flag F5 is set to "1" at step #61. If, however, it is determined at step #57 that the forced lightening flag F5 is not "1" and the forced lightening has already finished, the lowest temperature judging flag F4 is set to "0" at step #62 and then the forced lightening flag F5 is set to "1" at step #61. After that, the program flows to step #53.

If it is determined at step #47 that the overshoot preventing timer TM0 has been set, a determination is made at step #63 whether the a heat lamp switch-off timer TM6 has already finished. If the timer TM6 has finished, the forced lightening flag F1 is set to "0".

When the timer TM0 has not been started but the timer TM5 has been started, determinations are made at steps #65 and #66 whether the timer TM5 has finished and then the forced lightening flag F5 is "1". If the flag F5 is "1", the flag F1 is changed to "0" at step #64. If, however, the flag F5 is "0", the heat lamp 26 is switched off at step #67 and then the timer TM6 is started at step #68.

At next step #69 it is determined whether the lowest temperature judging flag F4 is "1". When the flag F4 is "1", i.e., the lowest temperature is more than the T6, a determination is made at step #70 whether a timer T has finished. As shown in FIG. 17, the timer T corresponds to a period of time in which the heat lamp is turned on and then off. Timers TM7 and TM8 define respective time periods during which the heat lamp 26 is turned on. One of these timers are used selectively depending upon the value of the flag F4 so that an on-duty ratio of the voltage applied to the heat lamp 26 for controlling the heat calory emitted therefrom can be changed.

Referring still to same flowchart, if it is determined at step #70 that the timer T has finished, the same timers T is started again at step #71, another timer TM7 is also started at step #72, and then the heat lamp 26 is turned on at step #73. Next, a determination is made at step #74 whether the timer TM7 has finished. Then, if the timer TM7 has finished, the heat lamp 26 is turned off.

If, however, it is determined at step #69 that the flag F4 is "0", another determination is made at step #76 whether the timer T has finished. If so, timers T and TM8 are started at respective steps #77 and TM8 and then the heat lamp 26 is turned on at step #79. Next, a determination is made at step #80 whether the timer TM8 has finished, and if so, the heat lamp 26 is turned off at step #81.

Note that the timer TM7 is longer than TM8. The timer TM7 or TM8 is selected depending upon the heat calory deprived by the sheet and thereby the time period for lightening the heat lamp 26 during the forced lightening control is adjusted. Once one of the timers TM7 or TM8 is started, it is determined at step #82 whether the temperature TEMP1 of the heat roller is lower than the temperature T2 stored in the RAM. If so, the M2 is updated to TEMP1 at step #83.

Figure 27:
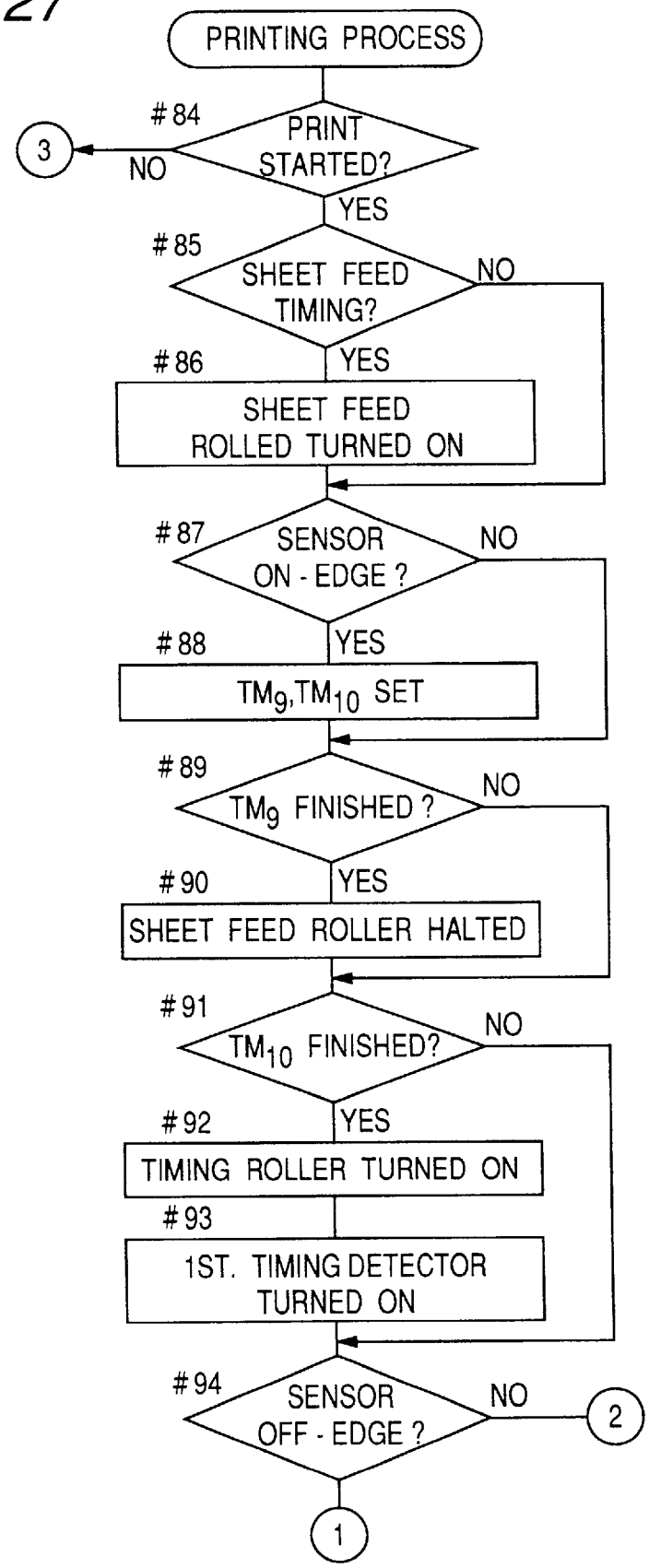
FIG. 27 is a flowchart of a printing process in the program.
Figure 28:
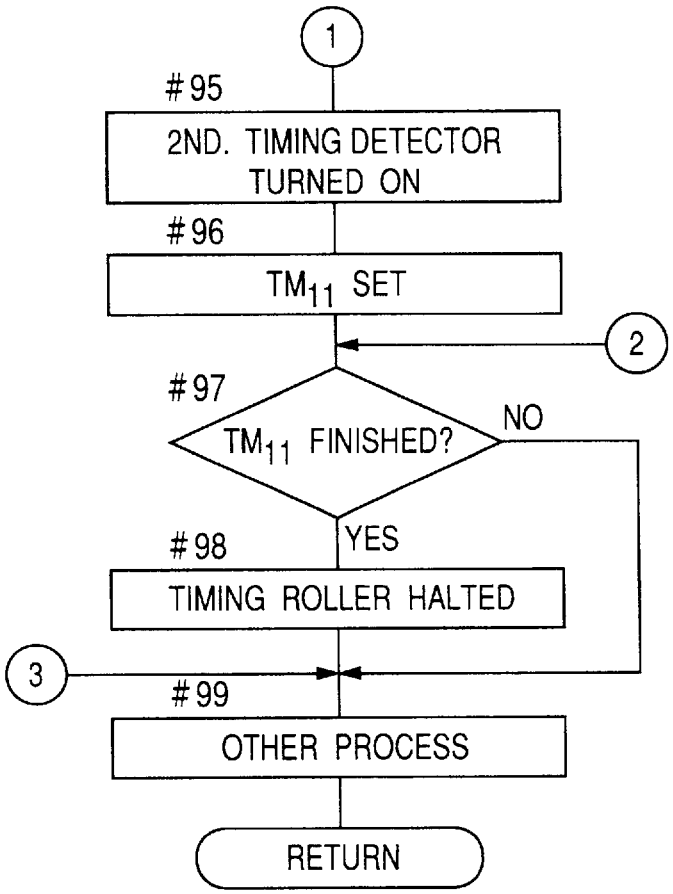
FIG. 28 is also a flowchart of the printing process subsequent to FIG. 27.

(8) Printing Control (see FIGS. 27 and 28)

In printing control at step #4, firstly a determination is made at step #84 whether the print start signal has been received by the controller 40. If not, the program jumps to other processes of step #99. If the print start signal is received by the controller 40, a determination is made at step #85 whether the sheet feeding from the feeder 10 is permitted. If the sheet is permitted to be fed, the sheet feed roller 11 is rotated to feed the sheet P from the sheet feeder at step #86. Next, it is determined at step #87 whether the sensor S has detected the leading edge of the sheet. When the sensor S detects the leading edge of the sheet, timers TM9 and TM10 are started at step #88. Another determination is made at step #89 whether the timer TM9 has finished. If so, the sheet feed roller 11 is halted at step #90. Further a determination is made at step #91 whether the timer TM10 has finished. If so, the timing roller 12 is driven to feed the sheet P toward the transfer station 13 at step #92 and the first timing detector is turned on at step #93. Next, a determination is made at step #94 whether the sensor S has detected the tailing edge of the sheet P. If so, the second timing detector is turned on at step #95, timer TM11 is started at step #96, and then a determination is made at step #97 whether the timer TM11 has finished. When the timer TM11 has finished, the timing roller 12 is halted at step #98 and then other process is carried out at step #99.

(9) Second embodiment of Warm-up Control

Figure 29:
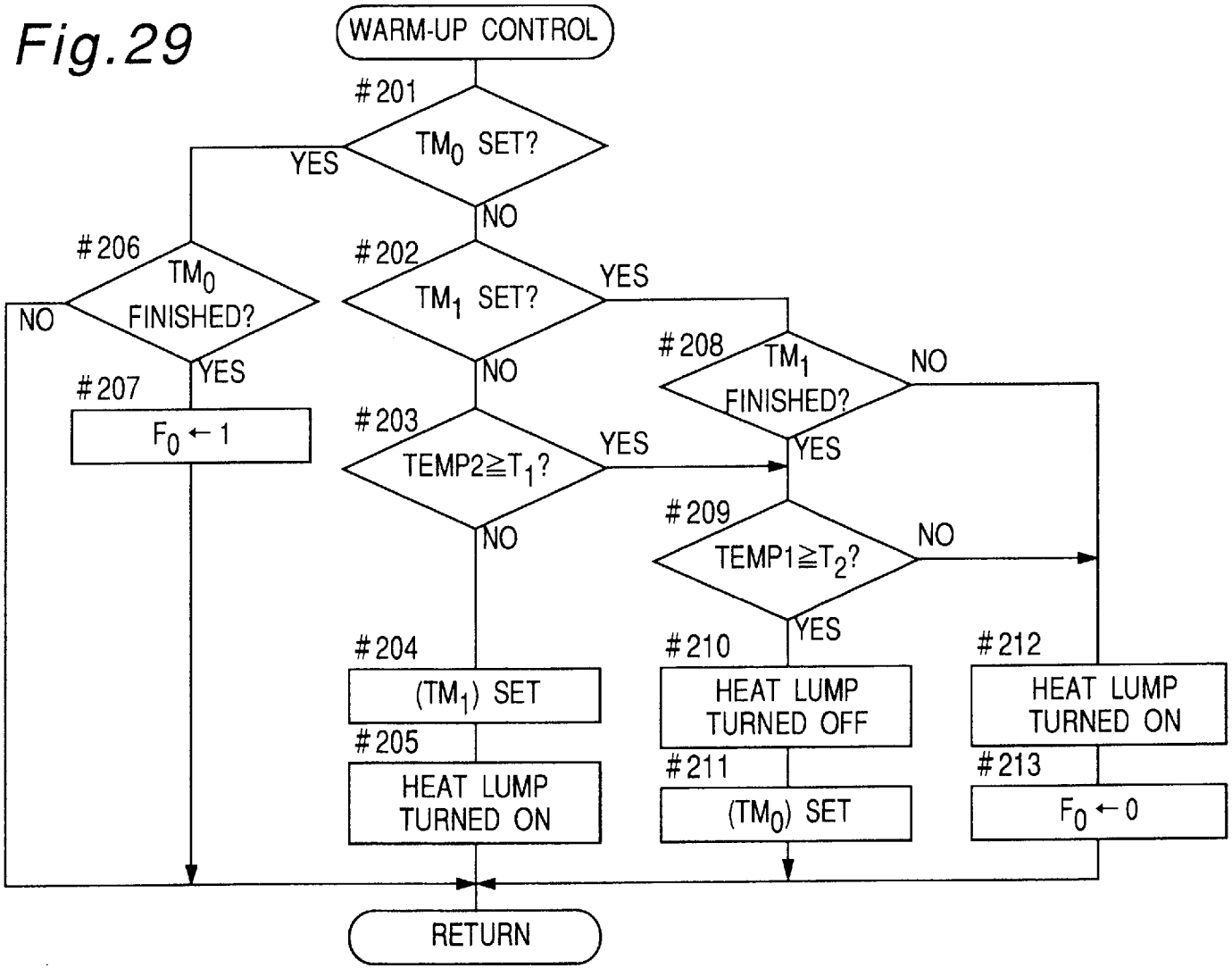
FIG. 29 is a flowchart of the warm-up control process of the second embodiment.

FIG. 29 shows the second embodiment of the warm-up control. In this embodiment, a determination is made at step #201 whether the overshoot preventing timer TM0 is set. If the timer TM0 has not been set, another determination is made at step #202 whether the pressure roller temperature control timer TM1 is set. As a result of this determination, if the timer TM1 has not been set, a determination is made at step #203 whether the temperature TEMP2 of the pressure roller 29 is equal to or greater than the pressure roller warm-up completion temperature T1. If the TEMP1 is lower than T1, the pressure roller temperature control timer TM1 is started at step #204 and the heat lamp 26 is turned on at step #205 so that the heat roller 22 and the belt 20 are heated.

If it is determined at step #201 that the overshoot preventing timer TM0 has already been set, a determination is made at step #206 whether the timer TM0 has finished. When the timer TM0 has finished, the warm-up control flag F0 is set to "1" at step #207.

Also, if it is determined at step #202 that the pressure roller temperature control timer TM1 has already been set, a determination is made at step #208 whether the timer TM1 has finished. If so, another determination is made at step #209 whether the temperature TEMP1 of the heat roller 22 is equal to or more than the heat roller warm-up completion temperature T2. If the TEMP1 is equal to or more than T2, the heat lamp 26 is turned off at step #210 and then timer TM0 is started at step #211. Contrary to this, when the TEMP1 is less than T2, the heat lamp 26 is turned on at step #212, and the warm-up control flag F0 is returned to "0" at step #213.

If it is determined at step #203 that the TEMP2 of the pressure roller 29 is equal to or more than the pressure roller warm-up completion temperature T1, another determination is made at step #209 whether the temperature TEMP1 of the heat roller 22 is equal to or more than T2. If the TEMP1 is equal to or more than T2, the heat lamp 26 is turned off at step #210 and then timer TM0 is set at step #211. If, however, the TEMP1 is less than T2, the heat lamp 26 is turned on at step #212 and the flag F0 is set to "0" at step "213 so that the heat roller 26 and the belt 20 are heated.

With this embodiment, the heat lamp 26 is turned on according to the temperature of the pressure roller 29 and is turned off according to the temperature of the heat roller 22, which makes the temperature control easier than the first embodiment.

(10) Second Embodiment of First Print Delay Process

Figure 30:
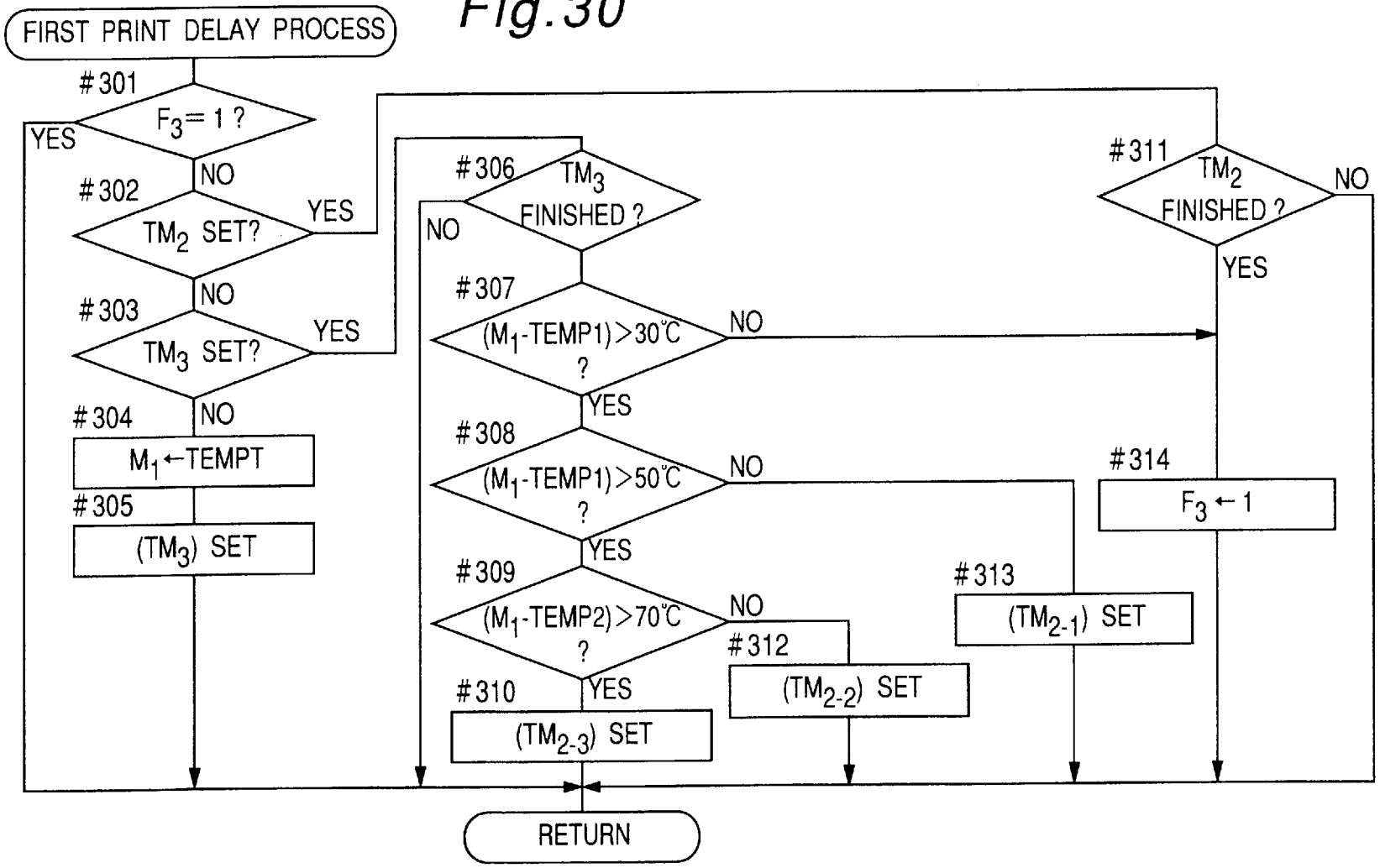
FIG. 30 is a flowchart of the first print delay process of the second embodiment.

FIG. 30 shows the second embodiment of the first print delay process. In this process, it is determined at step #301 whether the first print delay process completion judge flag F3 is "1", i.e., the first print delay process has finished. If the processing is carrying out at present, a determination is made at step #302 whether the first print delay timer TM2 (TM2-1, TM2-2, or TM2-3) has been set. When none of these timers is set, it is determined at step #303 whether a temperature drop check timer TM3 is set. If the temperature drop check timer TM3 is not set, the temperature TEMP1 at the beginning of printing is stored in the memory M1 at step #304 and the temperature drop check timer TM3 is started at step #305. When the timer TM3 is set, a determination is made at step #306 whether the timer TM3 has finished. Also, if the timer TM3 has finished, the temperature drop in the heat roller 26 is determined at steps #307 to #309. Specifically, at steps #307 to #309 the temperature M1 stored in the memory M1 is compared with the present temperature TEMP1. As a result, when the difference between them is more than 70° C., from 70° C. to 50° C., or from 50° C. to 30° C., the associated timer TM2-3, TM2-2, or TM2-1 (TM2-1<TM2-2<TM2-3) is set at steps #310, #312, or #313. If the difference is less than 30° C., the fist print delay process completion judge flag F3 is set to "1" at step #314.

On the other hand, if it is determined at step #302 that any one of timers TM2 (TM2-3, TM2-2, or TM2-1) has been set, a determination is made at step #311 whether the timer TM2 set has finished. If so, the first print delay process completion judge flag is set to "1" at step #314.

According to this embodiment, the timer TM is set depending upon the temperature of the heat roller 22 and therefore no device for detecting the temperature of the pressure roller is needed.

In the embodiments described above, the heat roller 22 includes the heat generator so as to heat the belt 20, though, a second heat generator may be arranged in other roller, e.g., drive roller 21, to heat the belt 20 at different places. With this arrangement, the roller having the second heat generator may be used as an assistant heat means and the forced lightening may be carried out for this assistant heat means.

Further, it is not necessary to arrange the heat generator in the roller, the heat generator may be arranged outside the roller. Moreover, the heat generator may be arranged without touching with the belt.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A belt fixing system, comprising:

a rotatably supported belt;

a heating member for heating the belt;

a pressure member which contacts with a circumference of the belt to form a nipping region therewith where a toner image supported on a sheet member is fixed onto the sheet member;

a sensor for sensing the sheet before it enters the nipping region;

means for cooperating with the sensor for determining a portion of the belt that has touched the sheet member at the nipping region; and a controller for controlling the heating member so that an amount of heat supplied to the belt is changed in response to a result of the cooperating means.

2. A system claimed in claim 1, wherein the controller controls the heating member so that the amount of heat supplied to the belt is increased shortly before said portion of the belt reaches the heating member.

3. A system claimed in claim 2, further comprising a detector for detecting a temperature drop of said portion of the belt after it has contacted with the sheet member at the nipping region, wherein the controller controls the heating member so that the amount of heat supplied to the belt is increased or decreased depending upon the temperature drop detected.

4. A system claimed in claim 3, wherein the detector includes means for measuring a temperature of a surface of the heating member and means for comparing the temperature measured by the measuring means and a predetermined reference temperature.

5. A system claimed in claim 3, wherein the heating member is a heat lamp, and the amount of heat supplied to the belt is increased or decreased by changing a duty ratio of a voltage to be applied to the heat lamp.

6. A method for compensating a temperature drop of a belt in a belt fixing system which includes a rotatably supported belt, a pressure member disposed in circumferential contact with the belt to form a nipping region therewith, and a heater for heating the belt, wherein a sheet member is moved past the nipping region and thereby an unfixed toner image is fixed on the sheet member, comprising:

sensing the sheet member with a sensor before it enters the nipping region;

determining a portion of the belt that has contacted with the sheet member at the nipping region based on a result of the sensor; and changing an amount of heat supplied to the belt in response to the determination of the portion of the belt that has contacted with the sheet member at the nipping region.

7. A method claimed in claim 6, wherein the heat supplied to the belt is started shortly before said portion of the belt reaches the heater.

8. A system claimed in claim 1, wherein the heating member is spaced away from the nipping region.

9. A system claimed in claim 1, wherein the belt is rotatably supported by a first roller and a second roller, the heater member is housed in the first roller, and the pressure roller presses through the belts on the second roller.

10. An image forming apparatus, comprising:

a fixing device which includes a rotatably supported belt;

a heating member for heating the belt; and a pressure member which contacts with a circumference of the belt to form a nipping region therewith where a toner image supported on a sheet member is fixed onto the sheet member;

a sensor that senses the sheet before it enters the nipping region;

means for cooperating with the sensor for determining a portion of the belt that has touched the sheet member at the nipping region; and a controller for controlling the heating member so that an amount of heat supplied to the belt is changed in response to a determining result of the cooperating means.

11. An image forming apparatus claimed in claim 10, wherein the controller controls the heating member so that the amount of heat supplied to the belt is increased shortly before said portion of the belt reaches the heating member.

12. An image forming apparatus claimed in claim 11, further comprising a detector for detecting a temperature drop of said portion of the belt after it has contacted with the sheet member at the nipping region, wherein the controller controls the heating member so that the amount of heat supplied to the belt is increased or decreased depending upon the temperature drop detected.

13. An image forming apparatus claimed in claim 12, wherein the detector includes means for measuring a temperature of a surface of the heating member and means for comparing the temperature measured by the measuring means and a predetermined reference temperature.

14. An image forming apparatus claimed in claim 12, wherein the heating member is a heat lamp, and the amount of heat supplied to the belt is increased or decreased by changing a duty ratio of a voltage to be applied to the heat lamp.

15. A belt fixing system comprising:

a belt rotatably supported by a first roller and a second roller;

a third pressure roller defining a nipping region between the second roller and the third pressure roller, the nipping region for fixing a toner image to a sheet transported to the nipping region;

a heating member for heating the belt at a location remote from the nipping region;

a sensor for sensing the sheet before it enters the nipping region;

a device that cooperates with the sensor for determining where a portion of the belt is that has already contacted the sheet at the nipping region; and a controller for controlling the heating member so that an amount of heat supplied to the belt is changed in response to a result of the device.

16. The system according to claim 15, further comprising a detector for detecting a temperature drop of said portion of said belt.

* * * * *